US005884643A

United States Patent [19]

Shimizu et al.

[11] Patent Number: 5,884,643

[45] Date of Patent: Mar. 23, 1999

[54] CLEANING METHOD AND CLEANING APPARATUS FOR SURFACE OF SHEET STEEL

[75] Inventors: Masuto Shimizu; Akio Adachi; Hiroyuki Ogawa; Hiroshi Kuwako; Norio Kanamoto; Masaji Shiraishi; Naotoshi Aoyama; Takeo Sekine, all of Chiba, Japan

[73] Assignee: Kawasaki Steel Corporation, Kobe, Japan

[21] Appl. No.: 615,203

[22] PCT Filed: Jul. 13, 1995

[86] PCT No.: PCT/JP95/01397

§ 371 Date: Mar. 11, 1996

§ 102(e) Date: Mar. 11, 1996

[87] PCT Pub. No.: WO96/02334

PCT Pub. Date: Feb. 1, 1996

[30] Foreign Application Priority Data

Jul. 18, 1994 [JP] Japan ..... 6-165408
Sep. 20, 1994 [JP] Japan ..... 6-225087

[51] Int. Cl.[6] ..... B08B 3/00; B21B 45/04

[52] U.S. Cl. ..... 134/172; 134/166 R; 134/167 R; 72/39

[58] Field of Search ..... 134/166 R, 167 R, 134/172; 72/39

[56] References Cited

U.S. PATENT DOCUMENTS 4,344,308 8/1982 Shimada et al. ..... 72/39

FOREIGN PATENT DOCUMENTS 0 047 731 A2 3/1982 European Pat. Off. .
3624794 A1 2/1988 Germany .
A-58-13409 1/1983 Japan .
B2-60-1085 1/1985 Japan .
60-66609 U 5/1985 Japan .
60-136807 U 9/1985 Japan .
62-155910 U 10/1987 Japan .
A-63-68214 3/1988 Japan .
A-4-138815 5/1992 Japan .
A-4-238620 8/1992 Japan .
A-5-261426 10/1993 Japan .
WO 84/01971 5/1984 WIPO .

OTHER PUBLICATIONS

"Impact Pressure of Water in Hydraulic Descaling during Hot Strip Mill Rolling", Iron & Steel, vol. 9, No. 77 (1991), Tadayoshi Wada et al., pp. 1450–1457 with partial English–language translation.

The Water Jet Technology Society of Japan (1993), "Water Jet Technical Dictionary", Issued by Maruzen Co., Ltd., 7 pages with partial English–language translation.

*Primary Examiner*—Ardin H. Marschel
*Assistant Examiner*—Jezia Riley
*Attorney, Agent, or Firm*—Oliff & Berridge, PLC

[57] ABSTRACT

There is provided a cleaning apparatus for a surface of a sheet steel capable of satisfactorily removing scale from a surface of a sheet steel before, for example, hot rolling. Waters (42*a*, 46*a*) are ejected from nozzles (42, 46), with an ejection pressure of 100 kg/cm$^2$, a flow rate of 60 liters/minute and an ejection angle of 20° with respect to normal of the surface (32*a*) of the sheet steel, toward a downward-stream end with respect to a carrying direction. On the other hand, waters (44*a*, 48*a*) are ejected also from nozzles (44, 48), with the same ejection pressure, flow rate and ejection angle as those of the nozzles (42, 46), but different in the ejecting direction. That is, waters (44*a*, 48*a*) are ejected toward an upward-stream end with respect to the carrying direction. In other words, waters (42*a*, 44*a*, 46*a*, 48*a*) are ejected from the nozzles (42, 44, 46, 48) alternately in opposite directions as to an upward-stream end with respect to said carrying direction and a downward-stream end with respect to said carrying direction.

14 Claims, 21 Drawing Sheets

CLEANING METHOD AND CLEANING APPARATUS FOR SURFACE OF SHEET STEEL

TECHNICAL FIELD

The present invention relates to cleaning method and cleaning apparatus for a surface of a sheet steel in which a surface of a sheet steel is cleaned, and more particularly to cleaning method and cleaning apparatus which may be preferably used, for example, when scale is removed from a surface of a sheet steel before a hot rolling process.

BACKGROUND ART

In manufacture of a hot-rolled sheet steel, usually, a slab is charged into a heating furnace in an oxidizing atmosphere to be heated with a temperature within a range of 1100°–1400° C. extending over several hours. The heated slab is hot-rolled repeatedly by a rolling machine extending over a plurality of number of times so that a predetermined thickness thereof is obtained. A high temperature heating extending over several hours causes scale to be created on a surface of the slab. If the scale is subjected to a hot rolling process in such a state that the scale does not sufficiently break away, the scale will encroach on the surface of the slab and as a result remains as a scale defect. The scale defect on the surface of the slab remarkably damages a surface nature. In addition, the scale defect will become a starting point of cracks in a bending processing or the like. These will be a cause of serious damage to quality of products. In view of this matter, hitherto, there are proposed several ways to prevent an occurrence of scale defects on a slab surface (a sheet steel surface). As one of the ways, there is known a scheme in which a water jet descaling apparatus (hereinafter, referred to as a descaler) for ejecting water at a pressure, for example, about 100–150 kg/cm$^2$ is disposed in a direction (a width direction of a sheet steel) which intersects substantially perpendicularly to a carrying direction of the sheet steel, and high pressure water is ejected from the descaler toward a surface of the sheet steel to separate and remove scale created on the surface of the sheet steel.

In general, according to the scheme as mentioned above, there are provided a plurality of arrays of the descaler each being equipped with a plurality of nozzles in a longitudinal direction thereof (a width direction of a sheet steel) to eject water toward the surface of the sheet steel. In order to prevent scale removed by water ejected from the respective nozzles from entering a rolling machine which is installed at the downward-stream end with respect to the carrying direction of the sheet steel, water is ejected from the descaler of each of the arrays toward the upward-stream end with respect to the carrying direction of the sheet steel. By the way, water ejected from the descaler disposed at the downward-stream end with respect to the carrying direction toward the upward-stream end with respect to the carrying direction flows on the surface of the sheet steel up to a collision area in which water ejected from the descaler disposed at the more upward-stream end with respect to the carrying direction than the noticed descaler collides with surface of the sheet steel. Hence, water ejected from the descaler disposed at the more upward-stream end with respect to the carrying direction than the noticed descaler does not collide directly with surface of the sheet steel, but collides once with water ejected from the descaler disposed at the more downward-stream end with respect to the carrying direction and flowing on the surface of the sheet steel. As a result, water ejected from the descaler disposed at the more downward-stream end with respect to the carrying direction serves as a cushion, so that an impact force of water ejected from the descaler disposed at the more upward-stream end with respect to the carrying direction to the surface of the sheet steel will be reduced. Thus, this will be a cause of such a problem that it is difficult to implement a sufficient descaling.

Further, as another method of the scale eliminating ways, there is proposed a method (refer to Japanese Patent Laid Open Gazette No. 502113/1984) in which as shown in FIG. 21, water 14*a* is ejected from a cooling header 14 disposed at the upward-stream end with respect to the carrying direction 12 of a sheet steel 10 toward the upward-stream end with respect to the carrying direction, while water 16*a* is ejected from a cooling header 16 disposed at the downward-stream end with respect to the carrying direction 12 toward the downward-stream end with respect to the carrying direction, and thus water 14*a* ejected from the cooling header 14 disposed at the upward-stream end flows on a surface of the sheet steel, as shown by arrow 14*b*, toward the upward-stream end with respect to the carrying direction, while water 16*a* ejected from the cooling header 16 disposed at the downward-stream end flows on the surface of the sheet steel, as shown by arrow 16*b*, toward the downward-stream end with respect to the carrying direction, whereby water ejected from the cooling header 14 and water ejected from the cooling header 16 do not interfere with each other on the surface of the sheet steel so as to collide directly with the surface of the sheet steel.

According to the method described in the Gazette referenced above, while water ejected from the cooling header 14 and water ejected from the cooling header 16 do not interfere with each other on the surface of the sheet steel, water ejected from each of a plurality of nozzles disposed on a single cooling header will be emitted with a spread. Hence, waters ejected from adjacent nozzles will interfere with each other on the surface of the sheet steel. A state of the interference of water on a surface of a sheet steel will be explained referring to FIG. 22. FIG. 22 is a typical illustration showing on a plan view basis the state of the interference.

To perform a descaling, there is a need to cause water to have a collision extending over overall width of the sheet steel 10 being transported in the carrying direction 12. Consequently, water is emitted from the respective nozzle in such a manner that collision areas 20 and 22, in which waters emitted from the adjacent nozzles disposed on a single descaler (not illustrated) collide with a sheet steel surface 10*a*, partially overlap. While it is desired that the overlapped area is as narrow as possible, usually, the nozzles are arranged in such a manner that the overlapped area having 5 mm–10 mm in a direction of a sheet steel width is formed, since spread of the collision areas 20 and 22 will be varied owing to a variation in a distance between the sheet steel 10 and the nozzles, which variation caused by a variation in thickness of the sheet steel 10, and a spread of the collision area differentiates owing to an error in manufacture of nozzles.

In the overlapping area, water-to-water ejected from the mutually adjacent nozzles collide with each other, so that the collision force is reduced. Consequently, it is difficult to sufficiently remove scale. In order to provide a narrower overlapping area, there is considered a scheme in which as shown in FIG. 23, collision areas 24 and 26 for waters ejected from the mutually adjacent nozzles are staggered with respect to the carrying direction 12, and waters are ejected from the respective nozzles toward the upward-stream end with respect to the carrying direction 12. However, since water ejected toward the upward-stream end with respect to the carrying direction 12 will be emitted with a spread, water in the collision area 24 will be spread on the sheet steel surface 10*a* toward the upward-stream end with respect to the carrying direction 12. Thus, a part of waters serves as a cushion for water ejected to the collision area 26. As a result, in the area shown by an arrow 28, it may be considered that water ejected from the nozzle does not collide directly with the sheet steel surface. Thus, there is a fear such that scale in this area can not be sufficiently removed.

In order to solve the problem as mentioned above, there is considered a scheme in which the respective nozzles are arranged at sufficient intervals with respect to the carrying direction, and before water ejected from a nozzle spreads up to a collision area in which said water will collide with water ejected from another nozzle, said water is removed from a sheet steel surface. However, this method involves undesired problems in operation, such that it is needed to provide a space for installation of nozzles arranged at sufficient intervals with respect to the carrying direction, and conditions of descaling or cooling conditions by descaling are different owing to variance in temperature conditions on the sheet steel surface with which waters ejected from the respective nozzles arranged at sufficient intervals with respect to the carrying direction collide.

By the way, the quality of separativeness of scale in removal of scale is largely affected by the operational conditions such as water pressure of a descaler, and in addition the nature of scale, that is, composition and structure of scale and the like. Specifically, it is known that a primary scale created on a steel, which is large in the Si (silicon) content, is very difficult to be separated. The reason why such scale is very difficult to be separated is that when the steel, which is large in the silicon content, is oxidized through high-temperature heating, Si contained in the steel is subjected to the selective oxidization to form $2FeO.SiO_2$ (fayalite) which is large in thermal plasticity, so that a sub-scale layer possessing such a characteristic structure that the interface with the steel is complicated is formed. A heat treatment of the steel containing, for example, Si not less than 0.1% increases remarkably an amount of the sub-scale mentioned above. This sub-scale cannot be easily removed, as mentioned above. Thus, an infinite number of scale defects remains on a surface of a product after a rolling process. This will be a cause of a remarkable degradation of commercial value of products. Further, it happens that the secondary scale, which will be formed after a removal of the primary scale, does not break away by the above-mentioned method of ejecting high pressure water. Hence, this is in danger of an occurrence of scale defects.

As a technique to solve the foregoing problem, Japanese Patent Publication No. 1085/1985 discloses "a descaling method at hot rolling for a steel containing Si in which when a slab consisting of a steel containing 0.10–4.00% of Si is subjected to a hot rolling process to produce a hot-rolled sheet steel, descaling by a high pressure water jet of 80–250 $kg/cm^2$ is practiced not less than 0.04 seconds in a cumulative time during a rolling period of time in which a cumulative draft reckoning from a starting point of time of rolling is not less than 65% and an ingot piece temperature is 1000° C. Further, Japanese Patent Laid Open Gazette No. 238620/1992 discloses "a descaling method in which when a difficult-separative scale of steel species is subjected to a hot rolling process to produce a hot-rolled sheet steel, a high pressure water spray, given by a collision pressure per unit spraying area between 20 $g/mm^2$ and 40 $g/mm^2$ and a flow rate between 0.1 $liters/min \cdot mm^2$ and 0.2 $liters/min \cdot mm^2$, is ejected on a surface of the sheet steel prior to a finishing rolling.

As a nozzle for separating and removing difficult-separative scale, Japanese Patent Laid Open Gazette No. 261426/1993 proposes "a descaling nozzle in which an rectifying liquid flow channel is arranged on a longitudinal basis". In this Gazette, it is disclosed that the use of the descaling nozzle having a rectifier may increase the collision force comparing with the conventional nozzle, and thus it is effective for the difficult-separative scale of steel species.

However, according to the technique disclosed in Japanese Patent Publication No. 1085/1985 among the above-mentioned prior arts, there is a need to ensure a high FET (Finisher Entry Temperature), such as 1000° C. or more, and thus it is obliged to extract the sheet steel at high temperature. This involves such problems that unit requirement gets worse, and scale is increased. And in addition, the high temperature such as 1000° C. or more causes various restrictions in draft and descale time. This will be a cause of a complicated work in rolling.

According to the technique disclosed in Japanese Patent Laid Open Gazette No. 238620/1992, the collision pressure and flow rate of the high pressure water spray are defined to separate scale by an instantaneous collision force. In this technique, it is considered that the separative amount of scale depends on the collision pressure of the high pressure water spray. This concept has been described in detail in a paper "Collision pressure at the time of high pressure water descaling in hot rolling" appearing in a publication "Iron and Steel", 77(1991), Vol. 9. This paper discloses that consideration of variations in thermal expansion caused by a quenching action for scale with high pressure water and the minimum collision pressure for separating scale created on the various kinds of steels permits descaling to be satisfactorily performed. However, according to the technique as mentioned above, while most of the scale components are separated, a scale component having such a structure that scale encroaches on a ground metal will not be removed and thus remains. Hence, even after rolling, the scale defect referred to as a red scale remains. There arises the problems that such a scale defect becomes remarkable as the Si content is increased.

The above-mentioned Japanese Patent Laid Open Gazette No. 261426/1993 discloses structure and performance of the descaling nozzle equipped with the rectifier, but fails to disclose a method of the use in a hot rolling factory, for instance, the optimum distance between the nozzle and the sheet steel surface.

As a method of removing scale created on a surface of sheet steel, there is disclosed a method in which a liquid is ejected from a nozzle with a supplying pressure between 1000 $Kg/cm^2$ and 10000 $Kg/cm^2$ so that droplets formed in a droplet stream area of the liquid collide with a surface of a sheet steel, thereby removing scale (refer to Japanese Patent Laid Open Gazette No. 138815/1992). However, according to the method referenced above, since the supplying pressure of the liquid is not less than 1000 $Kg/cm^2$, there arises the problems that this method is unfavorable in economy and maintenance of facilities for supplying liquid.

In view of the foregoing, it is an object of the present invention to provide cleaning method and cleaning apparatus which may be preferably used, for example, when scale is removed from a surface of a sheet steel before a hot rolling process.

DISCLOSURE OF THE INVENTION

In order to achieve the object of the present invention, the invention provides a cleaning apparatus for a surface of a sheet steel in which a liquid is ejected toward the surface of the sheet steel being transported in a predetermined carrying direction to clean the surface of the sheet steel, characterized in that said cleaning apparatus comprises:

(1) a supplying tube, through which the liquid is supplied, extending in a direction intersecting said carrying direction; and (2) a plurality of nozzles for ejecting the liquid supplied to said supplying tube toward the surface of the sheet steel being transported in said predetermined carrying direction, said plurality of nozzles being coupled to said supplying tube in such a state that they are oriented to face alternately an upward-stream end with respect to said carrying direction and a downward-stream end with respect to said carrying direction along a longitudinal direction of said supplying tube.

Here, it is preferable that said plurality of nozzles are disposed, as shown in FIG. 11, in such a manner that an intersecting point X (X') of jet direction axes 146*c* and 148*c* (146*c'* and 148*c'*) of the nozzles 146 and 148 (146' and 148') and a plane 150 (150') perpendicularly intersecting a path line 170 from the central axis 141*a* (141'*a*) extending in the longitudinal direction of said supplying tube 141 (141') is located at the side of the sheet steel 32 over the central axis 141*a* (141'*a*).

Further, it is preferable that as shown in FIGS. 12 and 13, guard plates are installed so as to locate between the associated adjacent nozzles 148 connected with said supplying tube in a state that they face the upward-stream end with respect to the carrying direction along the longitudinal direction of said supplying tube 41 (141), and at the position which is nearer to the end of the sheet steel 32 than the tips (48*a*, 148*a*) of the nozzles. It is preferable that the guard plates are mounted also on a supplying tube 41 shown in FIG. 10 in a similar fashion to that of the above-mentioned matter.

In order to achieve the object of the present invention, the invention provides a cleaning method for a surface of a sheet steel in which liquids are ejected from a plurality of nozzles arranged in a direction intersecting a carrying direction of the sheet steel toward the surface of the sheet steel to clean the surface of the sheet steel, characterized in that the liquids are ejected from respective adjacent nozzles of said plurality of nozzles in mutually opposite directions as to an upward-stream end with respect to said carrying direction and a downward-stream end with respect to said carrying direction, so that said liquids collide with the surface of the sheet steel thereby cleaning the surface of the sheet steel.

Here, it is preferable that the liquids are ejected from said nozzles with an ejection angle within a range between 5° and 45° with respect to normal of the surface of the sheet steel.

Further, it is preferable that a temperature of the sheet of steel is given by over 850° C. and droplets produced in a droplet flow area of a flow of said liquids ejected from said nozzles collide with the surface of the sheet steel thereby cleaning the surface of the sheet steel.

Furthermore, it is preferable that when there is given a sheet steel containing over 0.5 wt % of Si, a surface temperature of the sheet of steel is given by over 850° C. and droplets produced in a droplet flow area of a flow of said liquids ejected from said nozzles collide with the surface of the sheet steel in the following condition thereby cleaning the surface of the sheet steel.

$$P(\mathrm{kg/cm^2})\times W(\mathrm{liter/cm^2}\geqq 0.8\times(\mathrm{wt\ \%\ Si})$$

where

P denotes an ejection pressure

W denotes an amount of liquid to be ejected

Here, it is preferable that a distance L between said nozzles and the surface of the sheet steel is set up within a range satisfying the following equation.

$$y_L \leqq L \leqq y_H$$

$$y_H = 390000/(x+360)+P/5-960$$

$$y_L = 390000/(x+360)+P/29-960$$

P: an ejection pressure of liquid x: a spread angle (°) of nozzles $$10° \leqq x \leqq 50°$$

Further, it is preferable that after liquids are rectified, said liquids are ejected from said nozzles.

Furthermore, it is preferable that a distance L between said nozzles and the surface of the sheet steel is varied in accordance with the following equation, in compliance with a variation of said election pressure of said liquid.

$$L=y$$

$$y=390000/(x+360)+P/10-960$$

P: an ejection pressure of liquid ($\mathrm{kg/cm^2}$)

x: a spread angle (°) of nozzles

According to the cleaning apparatus for a surface of a sheet steel of the present invention, a plurality of nozzles is coupled to a supplying tube in such a state that they are oriented to face alternately an upward-stream end with respect to said carrying direction and a downward-stream end with respect to said carrying direction along a longitudinal direction of said supplying tube. This feature permits the liquids ejected from the adjacent nozzles to flow and spread on the surface of the sheet steel in the opposite directions as to an upward-stream end with respect to said carrying direction and a downward-stream end with respect to said carrying direction, and prevents the liquid ejected from another of the adjacent nozzles from flowing up to a collision area on the surface of the sheet steel. As a result, the liquids ejected from the respective nozzles collide directly with the surface of the sheet steel. Thus, it is possible to perform satisfactory cleaning on the the surface of the sheet steel. Further, before the liquids ejected from the respective nozzles collide with the surface of the sheet steel, the direction of liquid ejection from the adjacent nozzles are opposite, respectively. Thus, the liquids ejected from the respective nozzles do not interfere with each other thereby preventing a lowering of collision onto the surface of the sheet steel.

Here, in a case where the plurality of nozzles are disposed in such a manner that an intersecting point of jet direction axes of the nozzles and a plane perpendicularly intersecting a path line from the central axis extending in the longitudinal direction of the supplying tube is located at the side of the sheet steel over the central axis, it is possible to maintain at predetermined values a distance between the nozzles and the sheet steel and an ejection angle of liquid, respectively. As a result, it is possible to attain not only the miniaturization of the cleaning apparatus, but also the miniaturization of the overall facilities including equipment arranged around the cleaning apparatus.

Further, in a case where guard plates are installed so as to locate between the associated adjacent nozzles connected with said supplying tube in a state that they face the upward-stream end with respect to the carrying direction along the longitudinal direction of said supplying tube, and at the position which is nearer to the end of the sheet steel than the tips of the nozzles, even when a sheet steel having the curved tip portion and/or rear end portion, which is poor in the shape, is carried, the curved tip portion and/or rear end portion will contact with the guard plates, but will not contact with the nozzles. Consequently, it is possible to prevent damage of the nozzles by the sheet steel, thereby reducing frequency in exchange of the nozzles. Thus, it is possible to expect economical effects such as a reduction of the maintenance cost, and improvement in operation rate of facilities avoiding a line stop due to damage of the nozzles.

According to the cleaning method for a surface of a sheet steel of the present invention, the liquids are ejected from respective adjacent nozzles of said plurality of nozzles in mutually opposite directions as to an upward-stream end with respect to said carrying direction and a downward-stream end with respect to said carrying direction. In other words, the liquid is ejected from one of the adjacent nozzles toward the upward-stream end with respect to said carrying direction, whereas the liquid is ejected from another of the adjacent nozzles toward the downward-stream end with respect to said carrying direction. Thus, the liquids ejected from the adjacent nozzles flow and spread on the surface of the sheet steel in the opposite directions as to an upward-stream end with respect to said carrying direction and a downward-stream end with respect to said carrying direction, and prevents the liquid ejected from another of the adjacent nozzles from flowing up to a collision area on the surface of the sheet steel. As a result, the liquids ejected from the respective nozzles collide directly with the surface of the sheet steel. Thus, it is possible to perform satisfactory cleaning on the the surface of the sheet steel. Further, before the liquids ejected from the respective nozzles collide with the surface of the sheet steel, the liquids ejected from the adjacent nozzles are opposite in direction of ejection. Thus, the liquids ejected from the respective nozzles do not interfere with each other thereby preventing a lowering of collision onto the surface of the sheet steel. Further, according to the cleaning method for a surface of a sheet steel of the present invention, the ejecting direction of liquids is alternately changed in a state that the nozzles are adjacent to each other, but the nozzles are not arranged with sufficient interval therebetween with respect to the carrying direction. This feature involves no problems in operation, such as the matters of necessity of a wide space extending in the carrying direction for arrangement of a plurality of nozzles, and differences in conditions of descaling or cooling conditions by descaling.

Here, in a case where the liquids are ejected from the nozzles with an ejection angle less than 5° with respect to normal line of the surface of the sheet steel, it is likely that a flow of liquids on the surface of the sheet steel faces the opposite direction to the ejecting direction. Further, an impact force with which the ejected liquid acts on the surface of the sheet steel is determined by the vertical component with respect to the surface of the sheet steel of the velocity of a flowing fluid colliding with the surface of the sheet steel. Thus, in a case where the liquids are ejected from the nozzles with an ejection angle over 45° with respect to normal of the surface of the sheet steel, it is likely that an impact force with which the ejected liquid acts on the surface of the sheet steel is weakened. Therefore, it is preferable that the liquids are ejected from the nozzles with an ejection angle within a range between 5° and 45° with respect to normal of the surface of the sheet steel.

Further, in a case where a temperature of the sheet of steel is given by over 850° C. and droplets produced in a droplet flow area collide with the surface of the sheet steel, it is possible to remove even scale having a structure such that it encroaches on the ground metal thereby cleaning the surface of the sheet steel with greater degree.

Furthermore, in a case where there is given a sheet steel containing over 0.5 wt % of Si, liquids are ejected to collide with the surface of the sheet steel in such a manner that an ejection pressure P and an ejection amount W satisfy a predetermined condition. Thus, even there is formed a sub-scale having a special structure such that the interface between it and the steel is complicated owing to the contained Si, it is possible to remove the sub-scale layer thereby more clearing the surface of the sheet steel.

Here, setting up a distance L between the nozzles and the surface of the sheet steel within the above mentioned predetermined range makes it possible to set an optimum length according to the ejection pressure of liquid thereby efficiently cleaning the surface of the sheet steel.

Further, in a case where after liquids are rectified, the liquids are ejected, the distance L between the nozzles and the surface of the sheet steel is elongated comparing with the case of non-rectifying. This feature makes it possible to prevent damages of nozzles by sheet steels.

Furthermore, in a case where a distance L between the nozzles and the surface of the sheet steel is varied in compliance with a variation of the ejection pressure of the liquid, it is possible to set an optimum length according to the ejection pressure of liquid thereby more efficiently cleaning the surface of the sheet steel.

Next, there will be explained the droplet flow area as mentioned above.

A method of cleaning a surface of a sheet steel through collision of the droplets formed in a droplet flow area with the surface of the sheet steel utilizes an erosion effect of a water jet. As to the erosion effect of a water jet, it is described in detail in "Water Jet Technical Dictionary" (Edited by Japanese Water Jet Society; Issued by Maruzen Company Limited).

FIG. 1 is a typical illustration showing air high speed water jet characteristic of a water jet. In the water jet, there is known such an aspect that when droplets in a droplet flow area of the air high speed water jet characteristic shown in FIG. 1 collide with a collision object, impact waves occur by a rapid compression of the droplets, so that the collision object is eroded away by a water-impact effect due to the impact waves. It has been confirmed that a pressure rising on a collision surface reaches over several times the pressure with which liquid is ejected.

FIG. 2A is a perspective view showing a schematic construction of a jet type of nozzle used in a water jet, and FIG. 2B is a perspective view showing a schematic construction of a flat nozzle for use in descaling used in hot rolling. As shown in FIG. 2, it is necessary for a descaling nozzle 2 used generally in the hot rolling that the liquid ejected from the descaling nozzle 2 collide with the whole of width of the hot-rolled material, different from the way as to the matter of a jet type of nozzle 4 used in a water jet. For this reason, generally, nozzles referred to as a flat spray nozzle are arranged in a width direction of the hot-rolled material so that liquid 6 ejected from the nozzle is spread in the width direction of the hot-rolled material.

Next, there will be explained an experiment using the flat spray nozzle as mentioned above. In this experiment, the erosion experiment of an aluminum plate was carried out using the flat spray nozzle a shown in FIG. 2B.

In this experiment, a flat spray nozzle having 30° of a spread angle is adopted, and a distance (spray distance) between the nozzle and the aluminum plate is varied, where an ejection pressure of water is 450 kg/cm$^2$ and a flow rate is 100 liters/min. An amount of erosion during a period of 30 seconds is measured. This measurement was performed by means of evaluating a difference in weight of the aluminum plate before and after the experiment. A result of the experiment is shown in FIG. 3. In FIG. 3, the axis of ordinates denotes an amount of erosion (g/30 sec.) during a period of 30 seconds, and the axis of abscissas denotes a spray distance (mm). As shown in FIG. 3, also in the flat spray nozzle in a similar fashion to that of the water jet, there exists a continuous flow area, a droplet flow area and droplet diffusion area. It has become clear that an erosion peak clearly exists.

Next, experiments were carried out, using the same nozzle as the above-mentioned experiment, adopting Al5052 defined in JIS as an sample, while an ejection pressure of water is varied. FIG. 4 shows a result of the experiments. In FIG. 4, the axis of ordinates and the axis of abscissas are the same as those in FIG. 3, respectively. According to FIG. 4, as the ejection pressure of water is increased, a position 20 of the erosion peak moves farther than the nozzle. It is understood that a variation of the position of the erosion peak is in proportion to the ejection pressure of water.

Here, components and physical properties values of Al used in the experiments of FIGS. 3 and 4 are shown in tables 1 and 2, respectively. In the experiment of FIG. 3, pure Al shown in table 1 is adopted, and in the experiment of FIG. 4, Al5052 shown in table 2 is adopted.

TABLE 1

| Pure Al (A1050) (Wt %) | | | | | | | | |
|---|---|---|---|---|---|---|---|---|
| Si | Fe | Cu | Mn | Mg | Zn | Cr | Ti | Al |
| 0.25 | 0.40 | 0.05 | 0.05 | 0.05 | 0.05 | — | 0.03 | over 99.5 |

tensile strength 10 [Kg/mm$^2$]
Brinell hardness 26 [10/500]

TABLE 2

| A15052 (Wt %) | | | | | | | | |
|---|---|---|---|---|---|---|---|---|
| Si | Fe | Cu | Mn | Mg | Zn | Cr | Ti | Al |
| 0.25 | 0.40 | 0.10 | 0.10 | $2.2_d$ 2.8 | 0.10 | $0.15_d$ 0.35 | 0.03 | rest |

tensile strength 23 [Kg/mm$^2$]
Brinell hardness 60 [10/500]

Al5052 has higher strength in material properties and is hard to be eroded.

A relation between a spread angle of water and a position of the erosion peak was evaluated, adopting an Al5052 sheet as sample, at 450 kg/cm$^2$ of ejection pressure of water, using the same nozzle as the above-mentioned experiment. The position of the erosion peak denotes an optimum distance between the nozzle and a surface of the sample. A result of the experiment is shown in FIG. 5 in which the axis of ordinates denotes the optimum distance and the axis of abscissas denotes a spread angle of water. A relation between a spread angle, an ejection pressure of water and a position of the erosion peak (the optimum distance) is expressed, from FIGS. 4 and 5, by the following equation.

$$y=390000/(x+360)+P/10-960$$

where y: an optimum distance (mm)

x: a spread angle (°) of flat spray nozzles

P: an ejection pressure of water (kg/cm$^2$)

An applicable range of the above-noted equation is given by $10° \leqq x \leqq 50°$.

From FIG. 4, it can be confirmed that as ejection pressure of water is varied, a position of the erosion peak is varied, and in addition it is understood that there exists around the position of the erosion peak a range in which an amount of erosion is not so less than that of the erosion peak. Consequently, according to FIG. 4, it is understood that the range in which the erosion value by the flat spray nozzle is over 50% of the erosion peak value is Here, it is preferable that a distance L between said nozzles and the surface of the sheet steel is set up within a range satisfying the following equation.

$$y_L \leqq L \leqq y_H$$

$$y_H=390000/(x+360)+P/5-960$$

$$y_L=390000/(x+360)+P/29-960$$

where L denotes a distance between the flat spray nozzle and the surface of the sheet steel.

With respect to water ejected from the flat spray nozzle, since it is assumed that a uniform flow rate distribution is obtained over the width direction of the sheet steel, the use of the flat nozzle less than 10° in spread angle of water increases a number of pieces of nozzle. On the other hand, the use of the flat nozzle over 50° in spread angle of water decreases a number of pieces of nozzle. In this case, however, it is hardly to obtain a uniform flow rate distribution over the width direction of the sheet steel, since the angle is too spread. For these reasons, it is preferable that the spread angle of nozzle is set up between 10° and 50°. With respect to a distance between the nozzle and the surface of the sheet steel, there is a fear such that setting up the nozzle too close to the surface of the sheet steel causes the nozzle to contact with the surface of the sheet steel, and as a result the nozzle will be damaged and also there will occur defects on the surface of the sheet steel. For this reason, it is preferable that both are separated from each other as far as possible. However, considering from the view point that it is very important for cleaning of the surface of the sheet steel in descaling and the like that the impact force of water ejected form the nozzle is effectively utilized, it is desirable in design of apparatuses that a distance between the nozzle and the surface of the sheet steel is set up within a range between a peak position of erosion and a position which is far from the peak position of the erosion but the impact force is still effective thereat.

Setting up the optimum distance between the nozzle and the surface of the sheet steel to meet the ejection condition (e.g. the ejection pressure) of the spray makes it possible to implement the more effective descaling.

Next, there will be explained results of the erosion experiments for an aluminum plate using a flat spray nozzle equipped with a rectifier and a flat spray nozzle equipped with no rectifier. In the experiments, a flat spray nozzle having 30° of a spread angle is adopted, and a distance (spray distance) between the nozzle and the aluminum plate is varied, where an ejection pressure of water is 450 kg/cm$^2$ and a flow rate is 100 liters/min. An amount of erosion during a period of 30 seconds is measured. This measurement was performed, as mentioned above, by means of evaluating a difference in weight of the aluminum plate before and after the experiment.

A result of the experiment is shown in FIG. 6. In FIG. 6, the axis of ordinates denotes an amount of erosion (g/30 sec.) during a period of 30 seconds, and the axis of abscissas denotes a spray distance (mm). As mentioned above, also in the flat spray nozzle in a similar fashion to that of the water jet, there exists a continuous flow area, a droplet flow area and droplet diffusion area. It has become clear that an erosion peak clearly exists. To scrutinize the effects of the rectifier, in case of the nozzle having non-rectifier, it is understood that the spray distance involved in the erosion peak is near 50 mm, and a distance between the nozzle and the plate surface is very close. Hence, it is feared that the nozzle contacts with the plate owing to vibration of the plate and/or change of the plate thickness. On the other hand, according to the nozzle having a rectifier, the position of the nozzle at which the erosion becomes peak is sufficiently apart from the plate surface. Thus, it is possible to prevent the damage of the nozzle and the occurrence of defects on the plate.

Next, there will be explained the upper limit temperature in a case where liquids collide with a surface of a sheet steel to clean the surface of the sheet steel.

From a view point of erosion, the higher temperature of steel material is advantageous since the strength of the material is poor. However, realistically, it is not desirable since rising of the temperature involves rising of unit requirement of fuel of a heating furnace, an increment of oxidization loss of the slab in the heating furnace and the like. For these reasons, realistically, an extraction temperature determined on the basis of the quality of material of the steel becomes rate controlling, and the condition for collision of liquids with a surface of a sheet steel is selected to meet the extraction temperature.

In general, the extraction temperature of the heating furnace is 1300° C. which is substantially the maximum temperature. In a case where a surface of a sheet steel is subjected to a cleaning process before a finisher rolling mill, there exists the lower limit of temperature due to the quality of material of the steel, but there does not exist the clear upper limit of temperature. However, it is not desirable since too much rising the temperature of the sheet steel involves, in a similar to that of the foregoing, rising of unit requirement of fuel, an increment of oxidization loss of the slab in the heating furnace and the like. For these reasons, the maximum temperature of the sheet steel is substantially about 1100° C.

BEST MODE FOR CARRYING OUT THE INVENTION

The present invention will be explained in conjunction with the accompanying drawings, hereinafter. There will be described, here, such a case where there are used two descalers (an example of the cleaning apparatuses referred to in the present invention) each having a plurality of nozzles arranged in a direction which substantially perpendicularly intersects a carrying direction of a sheet steel, so that scale is removed from a surface of the sheet steel prior to finishing rolling.

Figure 7:
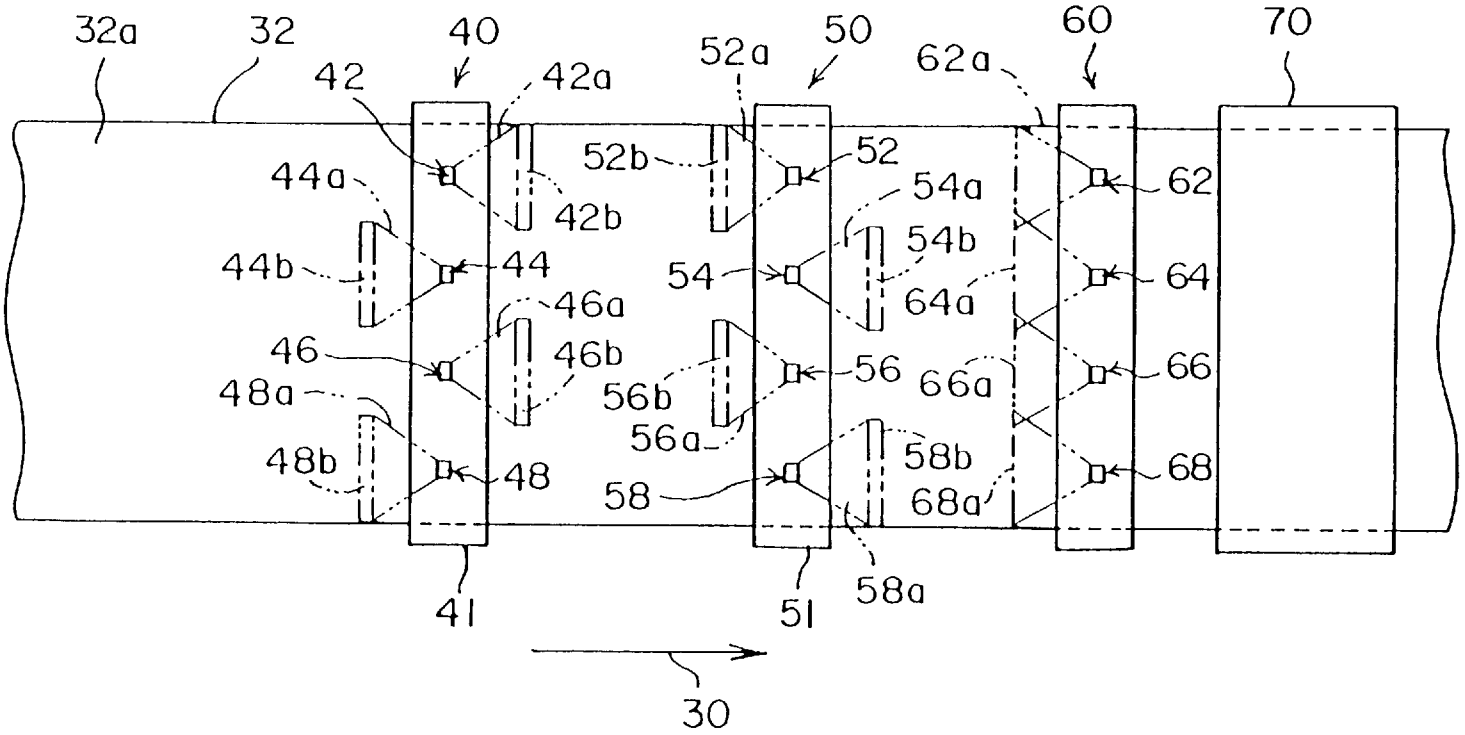
FIG. 7 is a typical illustration showing a state that water is ejected from nozzles of descalers, through the observation from the top over a sheet steel.
Figure 8:
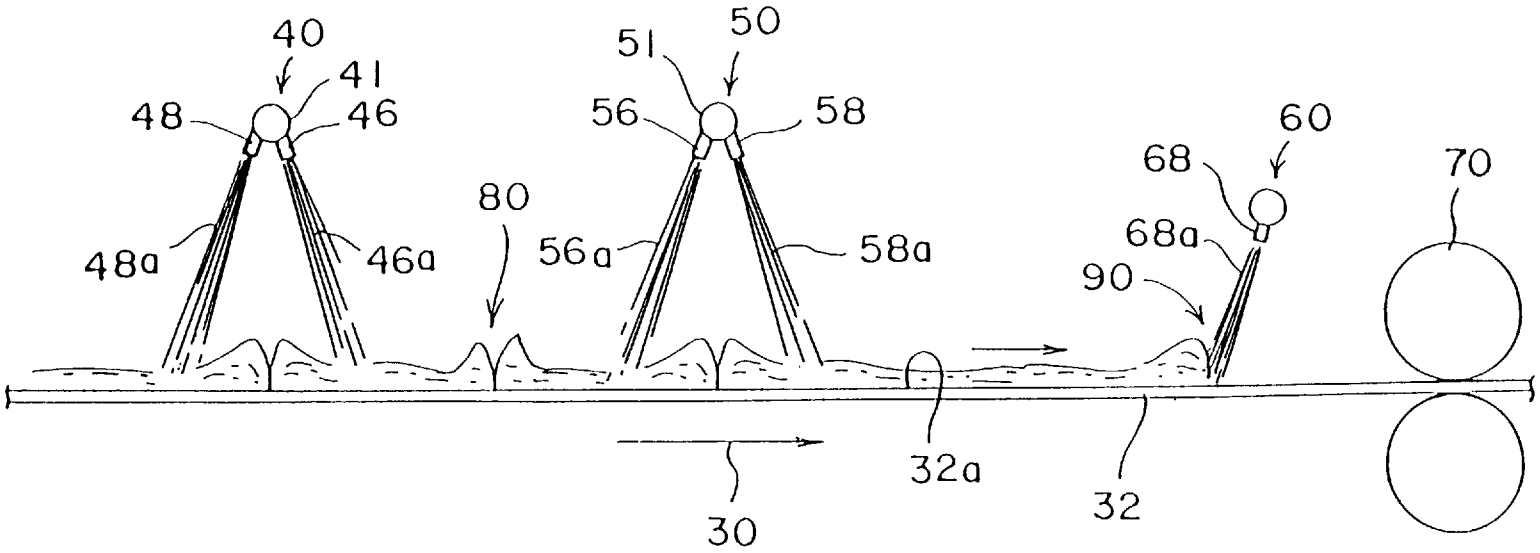
FIG. 8 is a typical illustration showing the descalers shown in FIG. 7 through the observation from the side of the sheet steel.

FIG. 7 is a typical illustration showing descalers in a state that water is ejected from nozzles thereof, through the observation from the top over a sheet steel. FIG. 8 is a typical illustration showing the descalers shown in FIG. 7, through the observation from the side of the sheet steel.

There are disposed descalers 40 and 50 over a sheet steel 32 transported in a carrying direction 30. The descalers 40 and 50 are equipped with cooling headers (an example of the supply pipes referred to in the present invention) 41 and 51 each extending in the direction substantially perpendicularly intersecting the carrying direction 30, respectively. On the cooling headers 41 and 51, there are arranged four nozzles 42, 44, 46 and 48; and 52, 54, 56 and 58, respectively. At the downward-stream end farther than the descaler 50 with respect to the carrying direction, there is disposed a descaler 60 for damming water ejected from the descaler 50. On the descaler 60, there are arranged four nozzles 62, 64, 66 and 68. At the downward-stream end farther than the descaler 60 with respect to the carrying direction, there is disposed a rolling roll 70 for rolling a sheet steel 32.

Waters 42*a* and 46*a* are ejected from the nozzles 42 and 46 of the descaler 40 toward the downward-stream end with respect to the carrying direction, respectively, with 100 kg/cm$^2$ of ejection pressure, 60 liters/minutes of flow rate and 20° of ejection angle with respect to normal of a surface 32*a* of the sheet steel. On the other hand, waters 44*a* and 48*a* are ejected from the nozzles 44 and 48 of the descaler 40, respectively, with the same ejection pressure, flow rate and ejection angle as the nozzles 42 and 46, but directed toward the upward-stream end with respect to the carrying direction. That is, waters 42*a*, 44*a*, 46*a* and 48*a* are ejected from the nozzles 42, 44, 46 and 48 alternately in mutually opposite directions of the upward-stream end with respect to the carrying direction and the downward-stream end with respect to the carrying direction. Waters 42*a*, 44*a*, 46*a* and 48*a* ejected from the nozzles 42, 44, 46 and 48 collide with the surface 32*a* of the sheet steel in collision areas 42*b*, 44*b*, 46*b* and 48*b*, respectively. As a result, waters ejected from the mutually adjacent nozzles 42, 44, 46 and 48 flow and spread on the surface 32*a* of the sheet steel in mutually opposite directions of the upward-stream end with respect to the carrying direction and the downward-stream end with respect to the carrying direction, but do not flow into the collision area of another of the adjacent nozzles. Thus, since waters ejected from the respective nozzles collide directly with the surface 32*a* of the sheet steel, it is possible to satisfactorily remove scale from the surface 32*a* of the sheet steel. Before waters ejected from the mutually adjacent nozzles 42, 44, 46 and 48 collide with the surface 32*a* of the sheet steel, ejecting directions of water ejected from the mutually adjacent nozzles are mutually opposite. Accordingly, waters ejected from the respective nozzles do not interfere with each other, whereby the collision force onto the surface of the sheet steel is not decreased.

Waters 54*a* and 58*a* are ejected from the nozzles 54 and 58 of the descaler 50 in the same condition as the nozzles 42 and 46 so as to collide with the surface 32*a* of the sheet steel in collision areas 54*b* and 58*b*, respectively. On the other hand, waters 52*a* and 56*a* are ejected from the nozzles 52 and 56 in the same condition as the nozzles 44 and 48 so as to collide with the surface 32*a* of the sheet steel in collision areas 52*b* and 56*b*, respectively. Consequently, this involves the same effect as the descaler 40.

Waters 46*a* and 56*a*, which are ejected from the nozzle 56 of the descaler 40 and the nozzle 56 of the descaler 50, respectively, run against each other in an area 80 on the surface 32*a* of the sheet steel and then are dammed, as shown in FIG. 8. Hence, it does not happen that water 46*a* ejected from the nozzle 46 spreads up to the collision area 56*b*. On the other hand, it does not happen that water 56*a* ejected from the nozzle 56 spreads up to the collision area 46*b*. This is the similar as to the matter of water 42*a* ejected from the nozzle 42 and water 52*a* ejected from the nozzle 52.

Further, as shown in FIG. 8, waters 54*a* and 58*a*, which are ejected from the nozzles 54 and 58 of the descaler 50, respectively, spread and flow on the surface 32*a* of the sheet steel toward the downward-stream end with respect to the carrying direction, that is, toward the rolling roll 70. These waters 54*a* and 58*a* contain a foreign body such as scale. Flowing of the foreign body into the rolling roll 70 will be a cause of doing damage to the sheet steel 32. For these reasons, waters 62*a*, 64*a*, 66*a*, and 68*a* are ejected from the nozzles 62, 64, 66 and 68 of the descaler 60, respectively, so as to dam at an area 90 water flowing on the surface 32*a* of the sheet steel. In this manner it is rendered possible to prevent the foreign body from flowing into the rolling roll 70.

Figure 9:
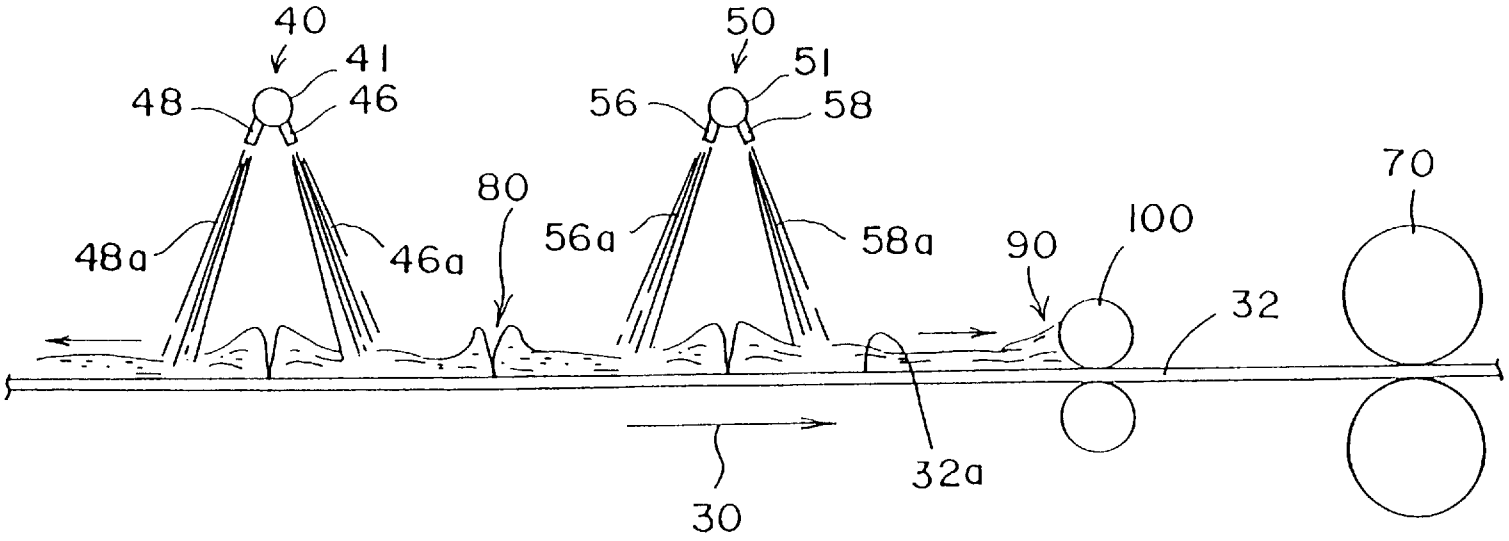
FIG. 9 is a typical illustration showing a state that water flowing on a surface of a sheet steel is dammed with the rolls.

FIG. 9 is a typical illustration showing a system in which water flowing on the surface 32*a* of the sheet steel is dammed at the area 90 with a pair of rolls 100 instead of the nozzle 60 in FIG. 8. In FIG. 9, the same parts are denoted by the same reference numbers as those of FIG. 8. Water flowing on the surface 32*a* of the sheet steel may be dammed also by the rolls 100. In this manner it is rendered possible to prevent the foreign body from flowing into the rolling roll 70.

Next, a structure of the descaler 40 will be explained. Incidentally, it is also similar as to the descaler 50.

Figure 10:
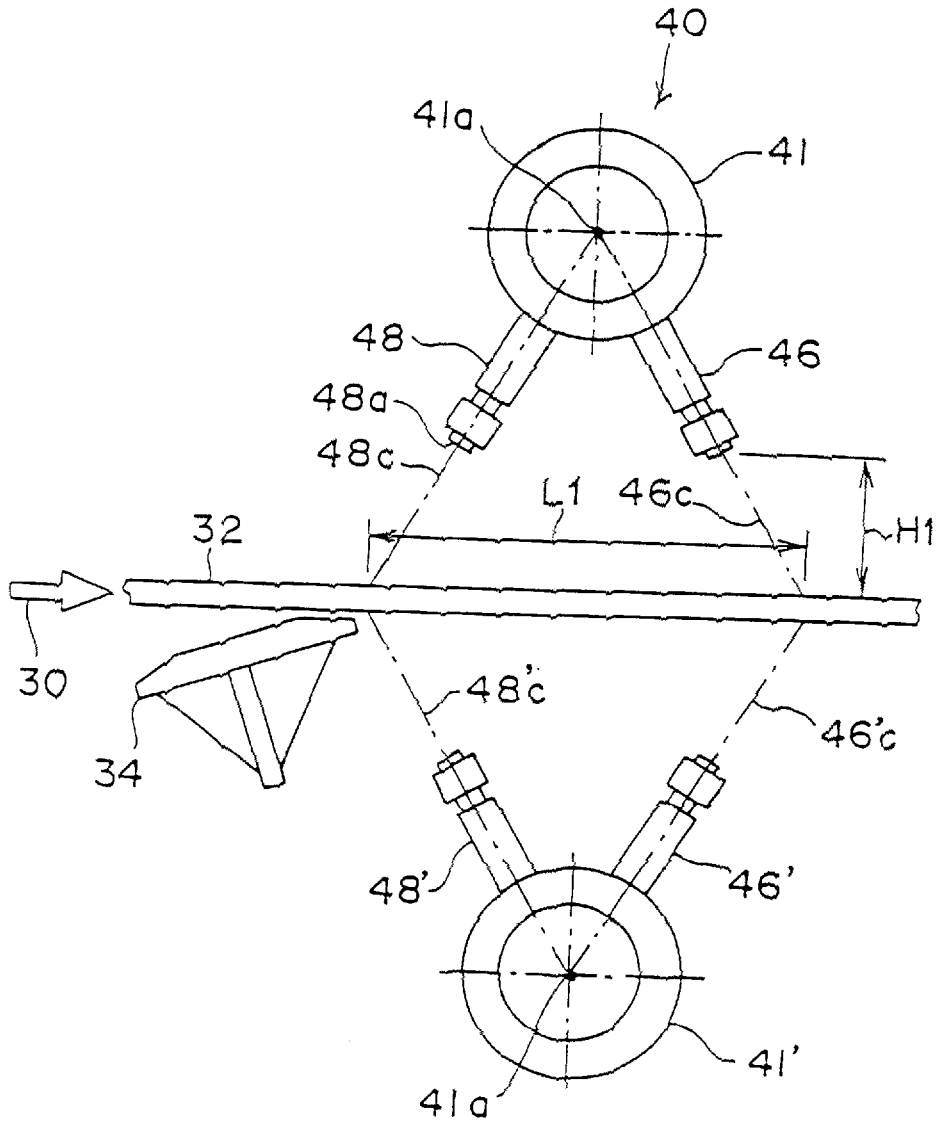
FIG. 10 is a typical illustration showing, by way of example, an arrangement of a descaler.
Figure 11A:
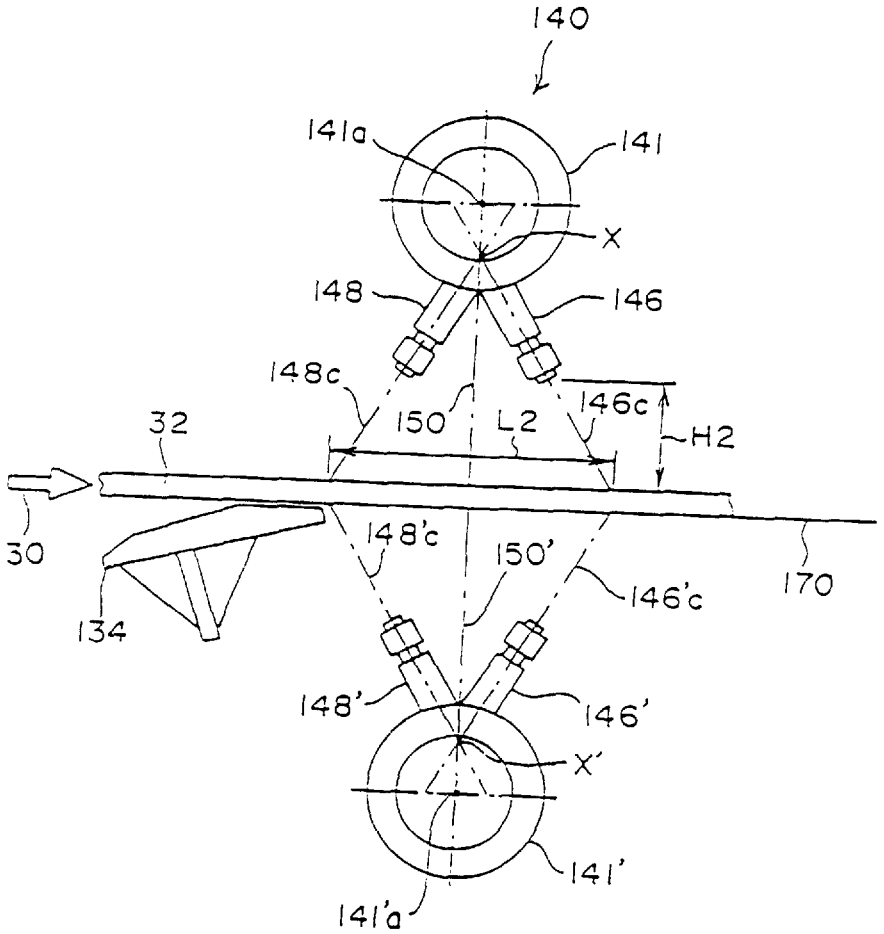
FIG. 11A is a typical illustration showing, by way of example, an arrangement of a descaler.
Figure 11B:
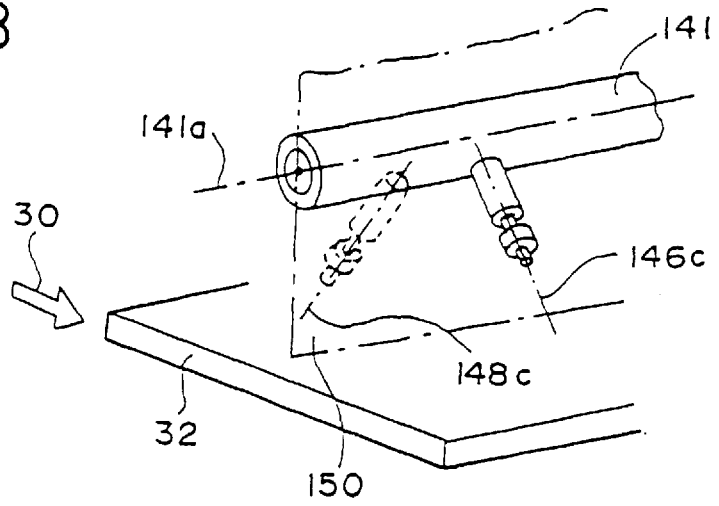
FIG. 11B is a perspective view of the same.

FIG. 10 shows, by way of example, an arrangement of the descaler 40. FIG. 11 shows, by way of example, other arrangements of the descaler 40.

As shown in FIG. 10, the descaler 40 is provided with a cooling header 41, to which water is supplied, extending in a direction substantially perpendicularly intersecting the carrying direction 30 of the sheet steel 32. Connected to the cooling header 41 are the above-mentioned four nozzles 42, 44, 46 and 48 (In FIG. 10, the nozzles 46 and 48 appear). The descaler 40 is provided with further cooling header 41' located over against the cooling header 41 crossing the sheet steel 32. Also connected to the cooling header 41' are four nozzles 42', 44', 46' and 48' (In FIG. 10, the nozzles 46' and 48' appear). Further, there is provided an apron 34 for preventing the tip of the sheet steel 32 from being caught in a sheet steel guide (not illustrated). The apron 34 is installed at the upward-stream end farther than the cooling header 41' with respect to the carrying direction 30.

The nozzles 42, 44, 46 and 48 (42', 44', 46' and 48') are connected with the cooling header 41 (41'), as mentioned above, in such a state that they are oriented to face alternately the upward-stream end with respect to the carrying direction and the downward-stream end with respect to the carrying direction along the longitudinal direction of the cooling header 41 (41'). The central axes 46*c* and 48*c* (46*c'* and 48*c'*) extending in the longitudinal direction of the nozzles 46 and 48 intersect the central axis 41*a* (41*a'*) extending in the longitudinal direction of the cooling header 41 (41'). The tips of the nozzles 46 and 48 are by distance H1 apart from the sheet steel 32, respectively. The intersecting position of the central axis 46*c* and the sheet steel 32 and the intersecting position of the central axis 48*c* and the sheet steel 32 are by distance L1 apart.

A descaler 140 shown in FIG. 11 is basically the same as the descaler 40 in the structure, but different from the descaler 40 in the connecting positions of the nozzles and the length of the nozzles.

As shown in FIG. 11, the descaler 140 is provided with a cooling header 141, to which water is supplied, extending in a direction substantially perpendicularly intersecting the carrying direction 30 of the sheet steel 32. Connected to the cooling header 141 are, for example, four nozzles 142, 144, 146 and 148 (In FIG. 11, the nozzles 146 and 148 appear). The descaler 140 is provided with further cooling header 141' located over against the cooling header 141 crossing the sheet steel 32. Also connected to the cooling header 41' are four nozzles 142', 144', 146' and 148' (In FIG. 11, the nozzles 146' and 148' appear). Further, there is provided an apron 134 for preventing the tip of the sheet steel 32 from being caught in a sheet steel guide (not illustrated). The apron 134 is installed at the upward-stream end farther than the cooling header 141' with respect to the carrying direction 30.

The nozzles 142, 144, 146 and 148 (142', 144', 146' and 148') are connected with the cooling header 141 (141') in such a state that they are oriented to face alternately the upward-stream end with respect to the carrying direction and the downward-stream end with respect to the carrying direction along the longitudinal direction of the cooling header 141 (141'). The connecting positions of those nozzles are given by such positions that an intersecting point X of jet direction axes 146*c* and 148*c* (146*c*' and 148*c*') of the nozzles 146 and 148 (146' and 148') and a plane 150 (150') perpendicularly intersecting a path line 170 from the central axis 141*a* (141'*a*) extending in the longitudinal direction of the cooling header 141 (141') is located at the side of the sheet steel 32 over the central axis 141*a* (141'*a*). The tips of the nozzles 146 and 148 are by distance H2 apart from the sheet steel 32, respectively. The intersecting position of the central axis 146*c* and the sheet steel 32 and the intersecting position of the central axis 148*c* and the sheet steel 32 are by distance L2 apart.

In comparing the descaler 40 shown in FIG. 10 with descaler 140 shown in FIG. 11, as mentioned above, there is no difference therebetween in the fundamental structure but the length of the nozzles and the connecting positions of the nozzles. Consequently, even the length of the nozzles 142, 144, 146 and 148 (142', 144', 146' and 148') is shorter than the length of the nozzles 42, 44, 46 and 48 (42', 44', 46' and 48'), it is allowed that distance H1 and distance H2 are equal to each other. Further, it is possible to reduce distance L2 to be about 0.8 times distance L1. Thus, according to the descaler 140 shown in FIG. 11, it is possible to satisfactorily prevent the interference between facilities disposed around the descaler 140 and the nozzles, Further, it is possible to attain not only a miniaturization of the descaler 140, but also a miniaturization of the overall facilities including the facilities disposed around the descaler 140. For the purpose of the maintenance of the descaler 140, it happens that the cooling header 141 is rotated on its central axis 141*a* and in addition the nozzles 142, 144, 146 and 148 are rotated. Even in this case, since the radius of rotation of the nozzles 142, 144, 146 and 148 can be shortened, it is possible to satisfactorily prevent the interference with the peripheral facilities. Incidentally, the radius of rotation of the nozzles 142, 144, 146 and 148 is about 0.9 times that of the nozzles 42, 44, 46 and 48. Further, since the apron 134 can be elongated more than the apron 34 by the corresponding reduction of distance L2, it is satisfactorily attain the catching-preventing function of the apron.

Next, there will be explained the guard plate provided on the descaler 140. Incidentally, it is noted that the descaler 150 is also equipped with the similar guard plate.

Figure 12:
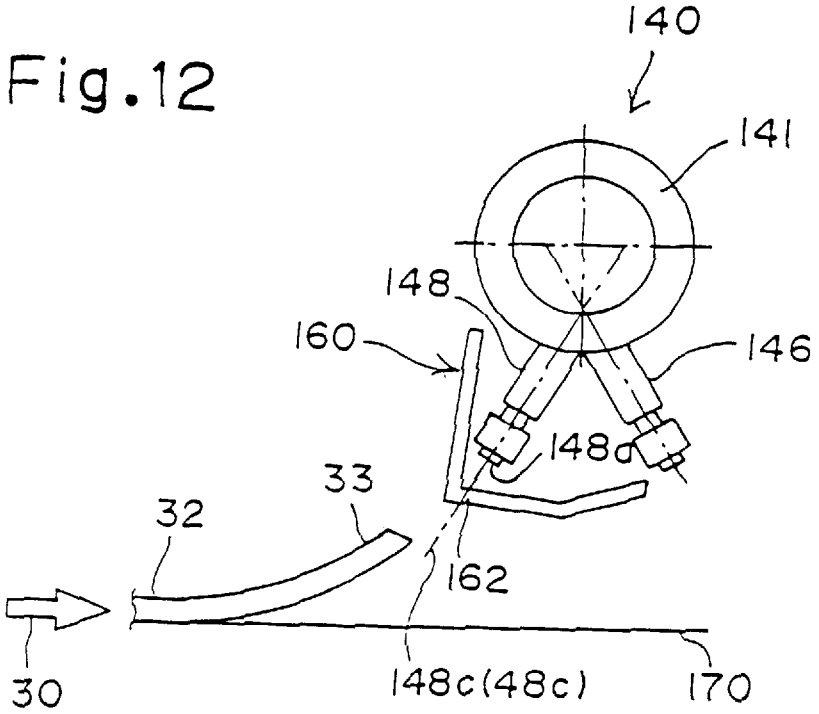
FIG. 12 is a side elevation showing a guard plate.
Figure 13:
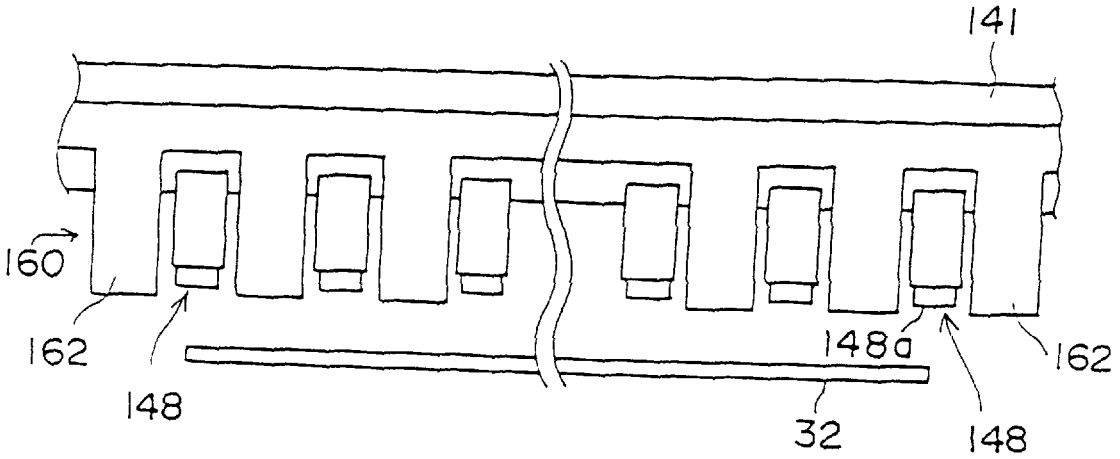
FIG. 13 is a plan view showing a guard plate.

FIG. 12 is a side elevation showing a guard plate, and FIG. 13 is a plan view showing the guard plate. Here, there is shown such a case that a lot of nozzles are connected with a cooling head.

A guard plate 160 serves to prevent the sheet steel 32 from contacting and colliding with the nozzles, and is arranged as the teeth of a comb. Guard members 162 of the guard plate 160 are installed so as to locate between the associated adjacent nozzles 148 connected with the cooling header 141 in a state that they face the upward-stream end with respect to the carrying direction 30 of the sheet steel 32, and at the position which is nearer to the end of the sheet steel 32 than the tips 148*a* of the nozzles 148.

For example, as shown in FIG. 12, when a sheet steel having the curved tip portion 33 and/or the rear end portion (not illustrated), which is poor in the shape, is carried, the sheet steel 32 will contact and collide with the guard members 162 of the guard plate 160, thereby preventing the contact and the collision of the sheet steel 32 with the nozzles 148. Consequently, it is possible to prevent damage of the nozzles 148 by the sheet steel 32, thereby reducing frequency in exchange of the nozzles 148. Thus, it is possible to expect economical effects such as a reduction of the maintenance cost, and improvement in operation rate of facilities avoiding a line stop due to damage of the nozzles 148. Incidentally, according to the above-mentioned example, while there is shown the guard plate 160 in which each of the guard members 162 is disposed between the associated adjacent nozzles 148, it is not always that each of the guard members. 162 is disposed between the associated adjacent nozzles 148 in its entirety. It is acceptable that the guard member 162 is disposed every other nozzle or third nozzle. Preferably, as shown in FIGS. 12 and 13, the guard members 162 are located between the nozzles 148 (48) in a comb-teeth-like configuration, and are disposed, taking a side view of the guard members 162, in such a manner that the guard members 162 stand straddling the central axes 148*c* (48*c*) of the nozzles. In this manner, it is possible to eject liquid protecting the nozzles 148 (48) and 146 (46). Further, it is acceptable that the guard plate 160 is set up on the descaler as shown in FIG. 10.

Next, there will be explained an embodiment of a method of cleaning a surface of a sheet steel. Here, there will be explained an example in which a cleaning method for a sheet steel surface according to the present invention is applied to a descaler for separating and removing scale from a high temperature of sheet steel surface.

Figure 14:
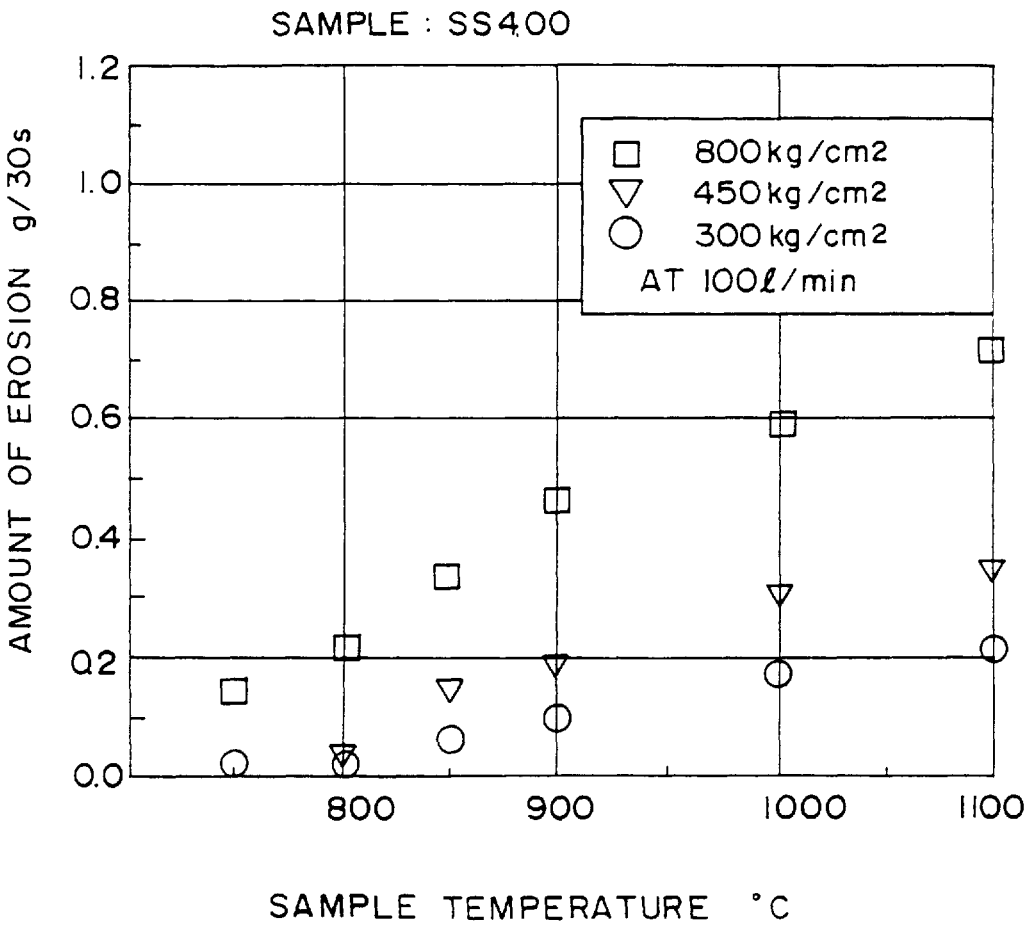
FIG. 14 is a graph showing a result of experiments in which scale is removed from an JIS SS400 sheet steel.

First, referring to FIG. 14, there will be explained experiments in which scale is removed from a sheet steel of SS400 defined in JIS standard. FIG. 14 is a graph showing a result of the experiments, where the axis of abscissas denotes a surface temperature of the sheet steel and the axis of ordinates denotes an amount of erosion. A measurement of an amount of erosion was performed through evaluation of a difference in weight of the sheet steel before and after the experiment.

According to the experiment, the descaler 40 shown in FIG. 7 is adopted and flat spray nozzles for use descaling having a 30° of spreading angle are used. A distance between the nozzles and the surface of the sheet steel is given by 100 mm. As shown in FIG. 14, it has been clarified that when a temperature of the sheet of steel becomes over 850 ° C. and an ejection pressure of water becomes over 300 kg/cm$^2$, the sheet steel is surely eroded. Usually, the sheet bar before a finish rolling machine is of 900° C. in temperature, and it is understood that an ejection pressure of water over 300 kg/cm$^2$ is needed to surely erode the surface of the sheet bar.

Next, referring to FIG. 15, there will be described the experiment in which scale is removed from a sheet steel containing 1.8 wt % of Si, in comparison with the prior art scheme. According to the experiment, with respect to steels containing Si which are apt to produce a difficult-separative scale referred to as red scale, an operating condition is controlled so that a surface temperature of the steel becomes 950° C., and then such a steel containing Si is subjected to a descaling process utilizing an erosion force. Further, in this experiment, the descaler 40 as shown in FIG. 7 is adopted and flat spray nozzles for use in descaling having a 30° of spreading angle are used.

Figure 15:
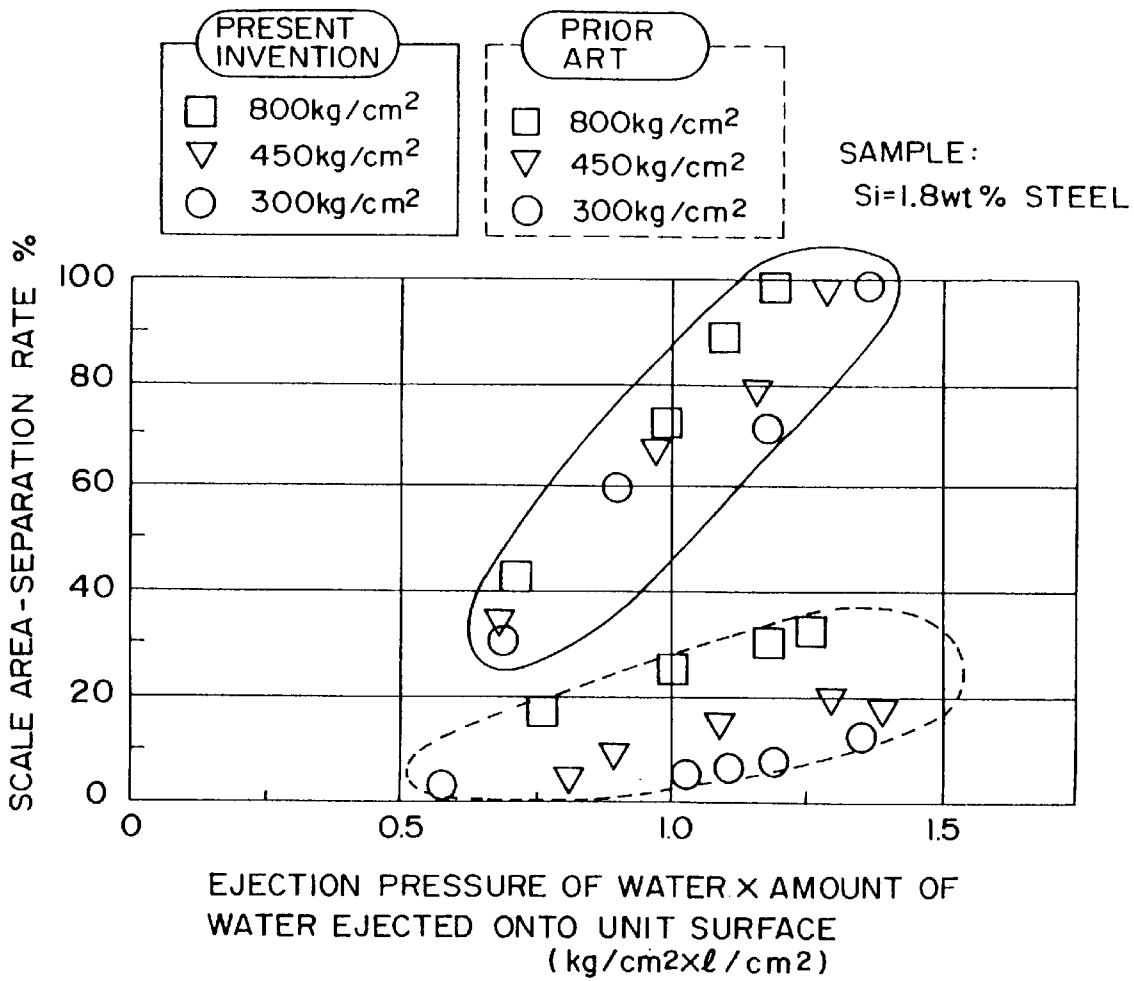
FIG. 15 is a graph showing a result of experiments in which scale is removed from a sheet steel containing 1.5 wt % of Si, in comparison with the prior art scheme.

FIG. 15 is a graph showing a result of experiments, where the axis of abscissas denotes the product of an ejection pressure of water and an amount of water ejected to a unit surface of the sheet steel and the axis of ordinates denotes scale area-separation rate. A measurement of the scale area-separation rate was performed by means of evaluation of a difference of the scale area before and after the experiment. The sheet steel contains 0.07 wt % of C and 1.7 wt % of Mn, as components other than Si.

Figure 1:
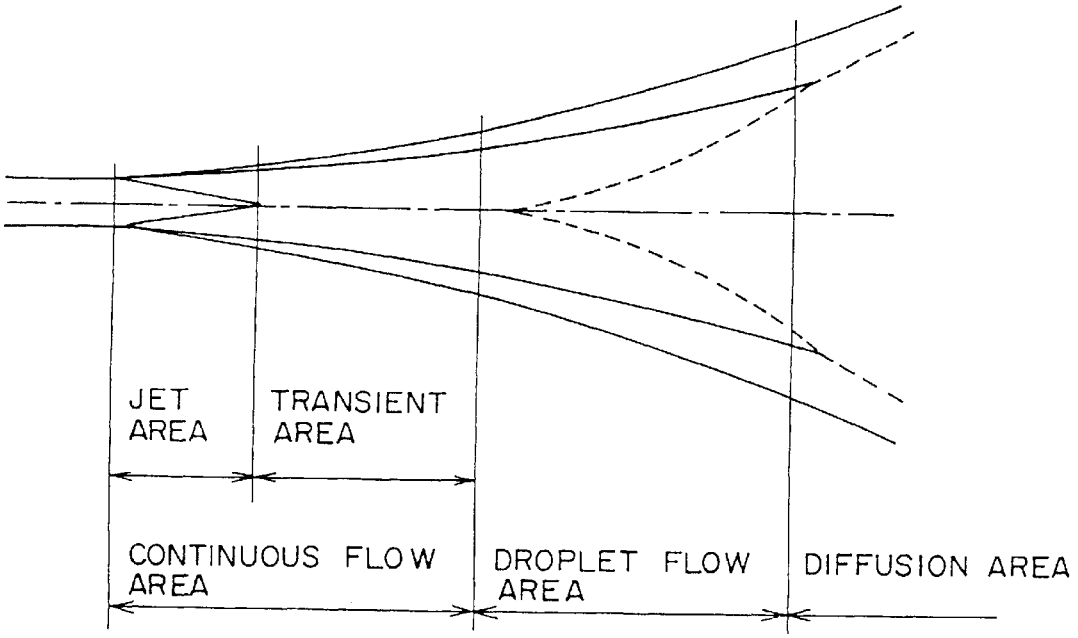
FIG. 1 is a typical illustration showing air high speed water jet characteristic of a water jet.
Figure 2A:
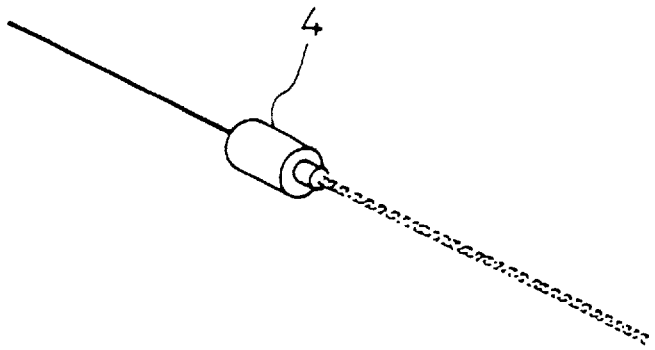
FIG. 2A is a perspective view showing a schematic construction of a jet type of nozzle used in a water jet.
Figure 2B:
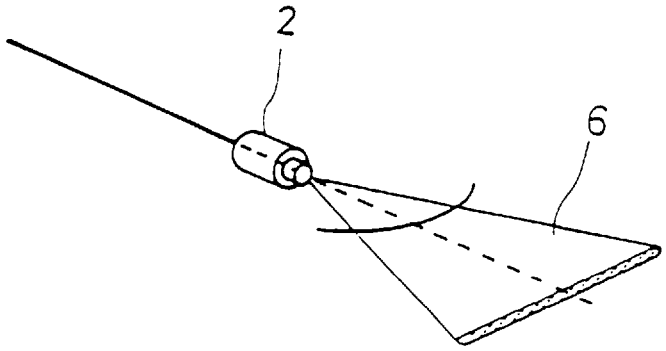
FIG. 2B is a perspective view showing a schematic construction of a flat spray nozzle for use in descaling used in hot rolling.
Figure 3:
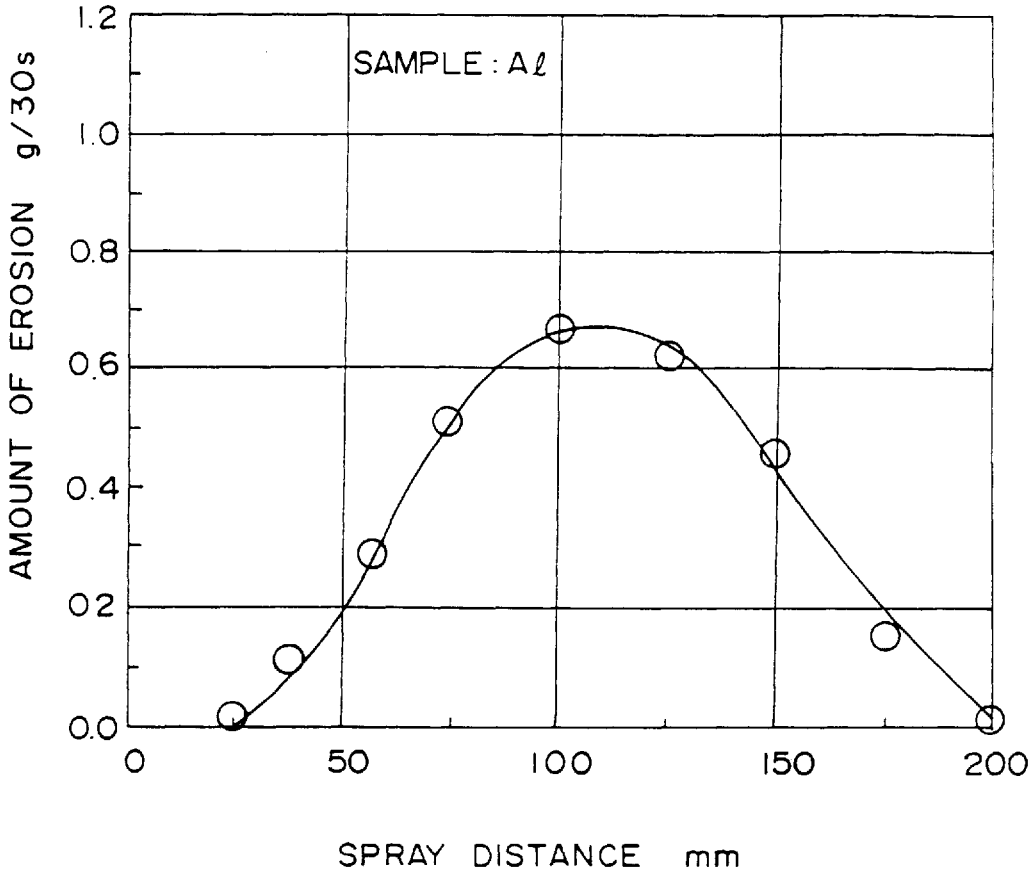
FIG. 3 is a graph showing a result of experiments on erosion of an aluminum sheet using a flat spray nozzle.
Figure 4:
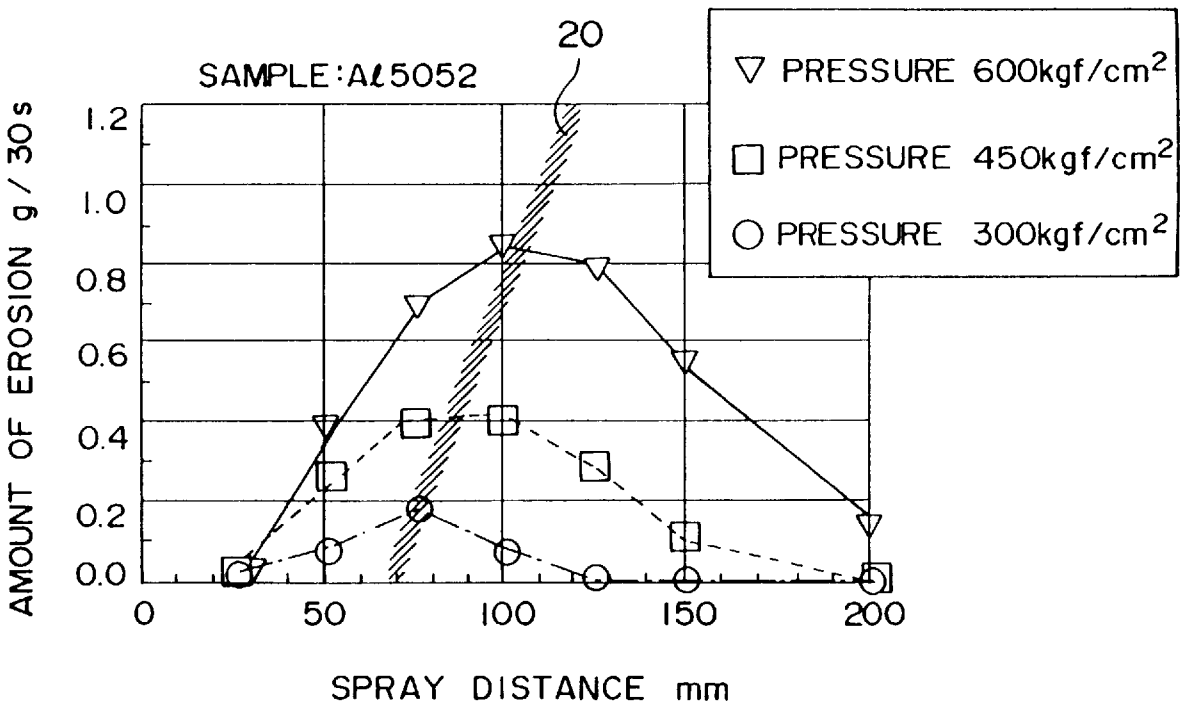
FIG. 4 is a graph showing a result of experiments on erosion of an JIS A1 5052 sheet through changing an ejection pressure of water, using a flat spray nozzle.
Figure 5:
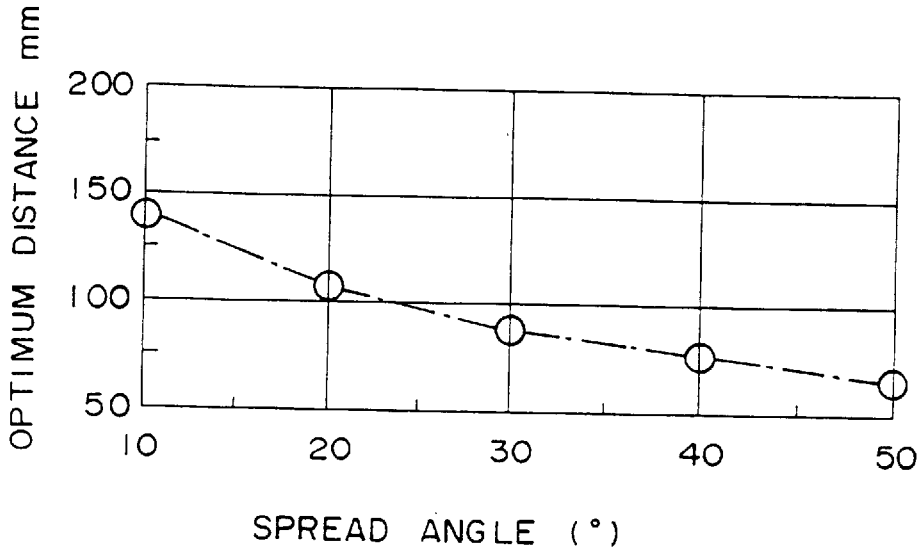
FIG. 5 is a graph showing a result of experiments on an JIS Al5052 sheet as sample at 450 kg/cm$^2$ of ejection pressure of water, using a flat spray nozzle.
Figure 6:
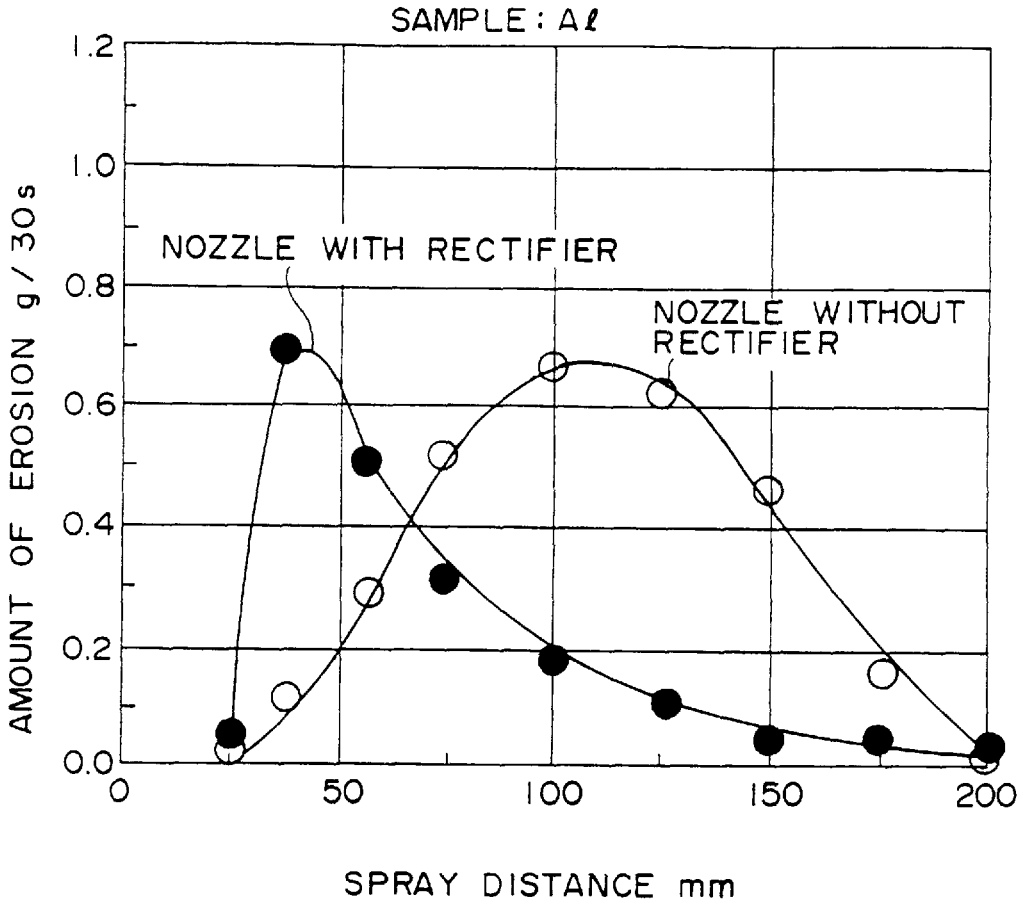
FIG. 6 is a graph showing a result of experiments on erosion of an aluminum sheet using a spray nozzle equipped with a rectifier and a spray nozzle having no rectifier.

As shown in FIG. 15, according to the present invention, the establishment of the necessary ejection pressure and the necessary amount of water (an amount of supply of water per unit area of a sheet steel) makes it possible to practice the satisfactory descaling. According to the prior art method, in order to avoid such a matter that at the time of the maintenance and the passage of a sheet steel, the sheet steel contacts with flat spray nozzles, in general, a distance between the nozzles and the sheet steel is set up to be above 200 mm. In view of the foregoing, in the present experiment, it is set up to be 200 mm. On the other hand, in the method according to the present invention, a distance between the nozzles and the sheet steel is set up on the basis of the result of the experiment shown in FIG. 4. In both the methods, an alteration of a flow rate is adjusted by an alteration of a caliber of nozzles. As shown in FIG. 15, in a case where the method of the present invention is applied to practice a descaling process, it is understood that scale is apparently reduced in comparison with the prior art method. Incidentally, according to the method of the present invention, a distance between the nozzles and the sheet steel is narrower in comparison with the prior art method, and thus it is necessary to devise a countermeasure to the contact and the like at the time of a passage of the sheet steel. In spite of the matter mentioned above, according to the method of the present invention, it is possible to expect a remarkable improvement in descaling, and thus apparently it is advantageous. It is possible to prevent the contact of the nozzles with the sheet steel by the use of the guard plate 160 shown in FIG. 13. An ejection pressure of water less than 1000 kg/cm$^2$ is suffice taking account of the maintenance end and the economical side of the facilities. While there is here shown an example as to a sheet steel containing Si, it is apparent that the cleaning method according to the present invention is applicable also to the matter as to other difficult-separative scale and is generally used through utilizing a principle of an erosion.

Next, referring to FIG. 16, there will be explained experiments in which scale is removed from each of three species of sheet steels containing 0.6 wt %, 1.0 wt % and 1.8 wt % of Si, respectively.

Figure 16:
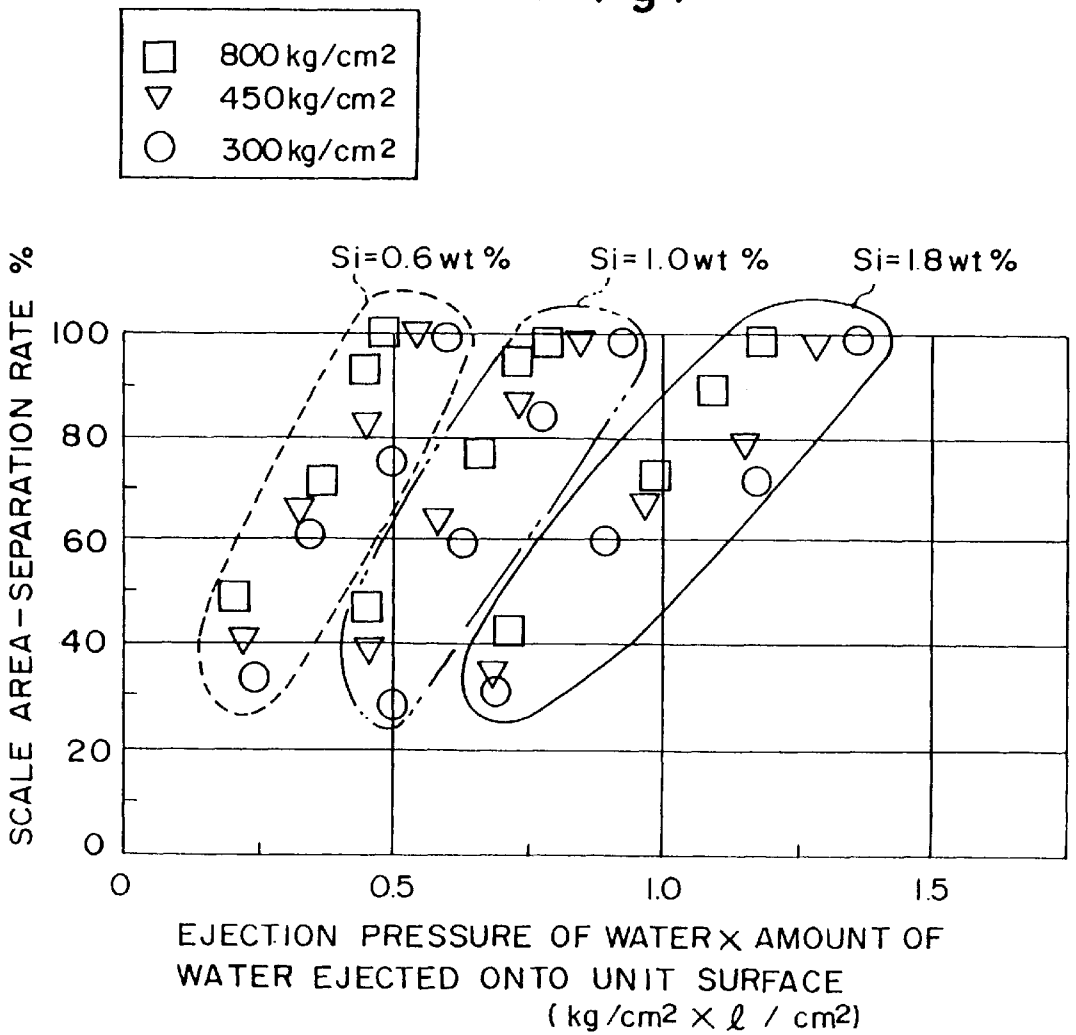
FIG. 16 is a graph showing a result of experiments in which scale is removed from each of three species of sheet steels containing 0.6 wt %, 1.0 wt % and 1.5 wt % of Si, respectively.

FIG. 16 is a graph showing a result of the experiments. The axis of abscissas and the axis of ordinates denote the same ones as those in the graph of FIG. 15. The experimental conditions are also the same as those in the graph of FIG. 15.

As shown in FIG. 16, since an amount to be eroded is increased as Si content is increased, there is needed an increment of an ejection pressure of water or an increment of an amount of water.

According to FIG. 16, it became clear that when the following condition is satisfied, an ejection pressure of water×an amount of water to be ejected to a surface of a sheet steel≧0.8×(% Si) [kg/cm$^2$×liter/cm$^2$×% Si]

with respect to steel species containing 0.5 wt % or more of Si, red scale can be completely removed. An ejection pressure of water less than 1000 kg/cm$^2$ is suffice taking account of the maintenance end and the economical side of the facilities.

According to the present embodiment, it is utilized that the flat spray nozzle for use in descaling also involves an impact force (water impact force) caused by a water jet, and the descaling is practiced in the optimum distance with which the impact force is attained. As a result, the impact force of the droplet may cause scale and the ground iron itself under the scale to be eroded, thereby completely removing also scale that encroaches on the ground iron. In this manner, according to the present invention, a scale area separation rate has been remarkably improved comparing with the prior art method in which an impact force is utilized to practice a separation of scale.

Figure 17:
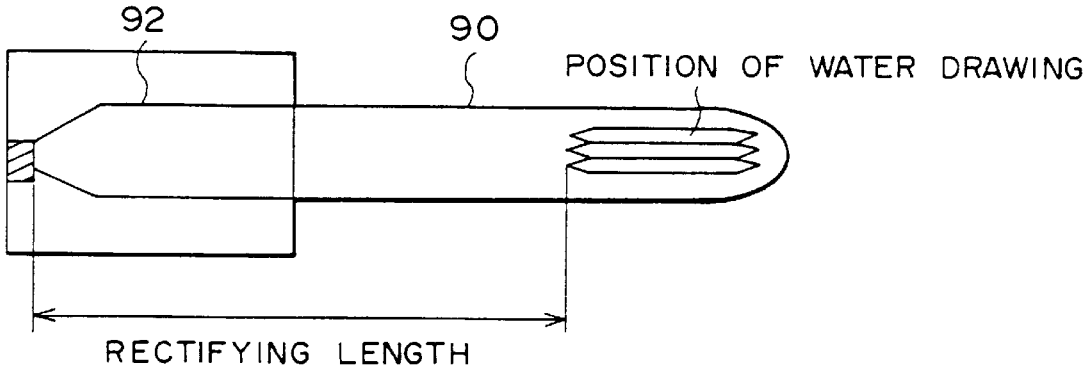
FIG. 17 is a schematic construction view showing a flat spray nozzle used in experiments in which water is ejected through rectifying the flow of water.
Figure 18:
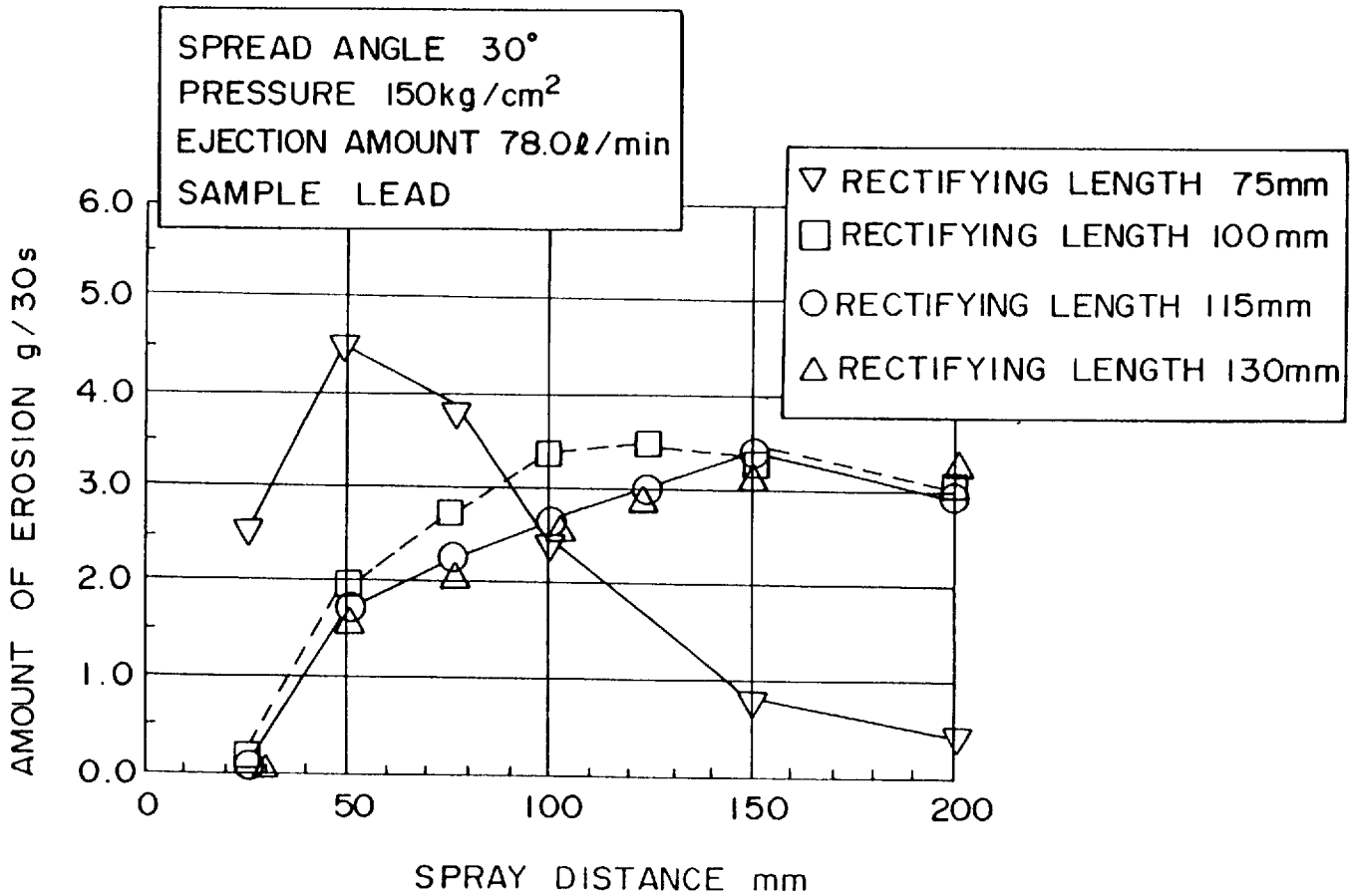
FIG. 18 is a graph showing a relation between a spray distance and an amount of erosion, among the results of experiments with the use of the flat spray nozzle shown in FIG. 17.
Figure 19:
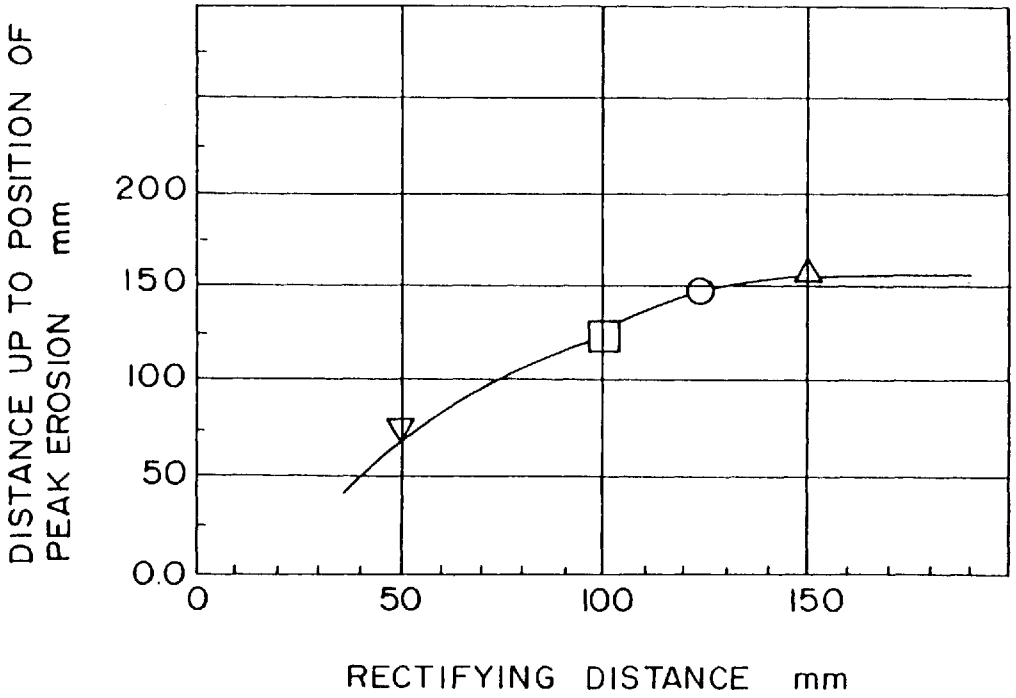
FIG. 19 is a graph showing a relation between a rectifying distance and a peak position of erosion, among the results of experiments with the use of the flat spray nozzle shown in FIG. 17.

Next, referring to FIGS. 17, 18 and 19, there will be explained experiments in which a flow of water is rectified to eject water. In the experiments, a lead plate is used and flat spray nozzles for use in descaling having 30° of a spread angle are adopted, and a distance between the nozzles and a surface of the lead plate is varied, where an ejection pressure of water is 150 kg/cm$^2$ and an amount of ejection of water per a unit area of the lead plate is 78.0 liters/min. FIG. 17 is a schematic construction view showing a flat spray nozzle used in experiments. FIG. 18 is a graph showing a relation between a spray distance and an amount of erosion. FIG. 19 is a graph showing a relation between a rectifying distance and a peak position of erosion.

As shown in FIGS. 18 and 19, when a length of a rectifier 90 (refer to FIG. 17) is extended, a peak position of erosion is varied even in the same nozzle condition. The shorter the rectifying distance, the closer to the nozzle is a peak position of erosion, whereas, the longer the rectifying distance, the farther from the nozzle is a peak position of erosion, but there is a tendency that the value is saturated.

In a case where the sheet bar in traveling is subjected to a descaling process, the lower end of the sheet bar is protected by a roll, but the upper end thereof is not protected. Hence, it is likely that running of a deformed sheet bar causes the sheet bar to collide with a nozzle chip 92 (refer to FIG. 17) and the nozzle is damaged. Consequently, while it is desired that water is ejected at the position which is apart from the sheet bar, there is no effect of the descaling on the position at which a water impact force is not exhibited. For these reasons, it is preferable that there is disposed a longitudinal rectifier to generate a water impact force at the position which is apart from the sheet bar as far as possible.

Next, there will be explained an embodiment in which a cleaning method for a sheet steel surface according to the present invention is applied to steels containing Ni.

Figure 20:
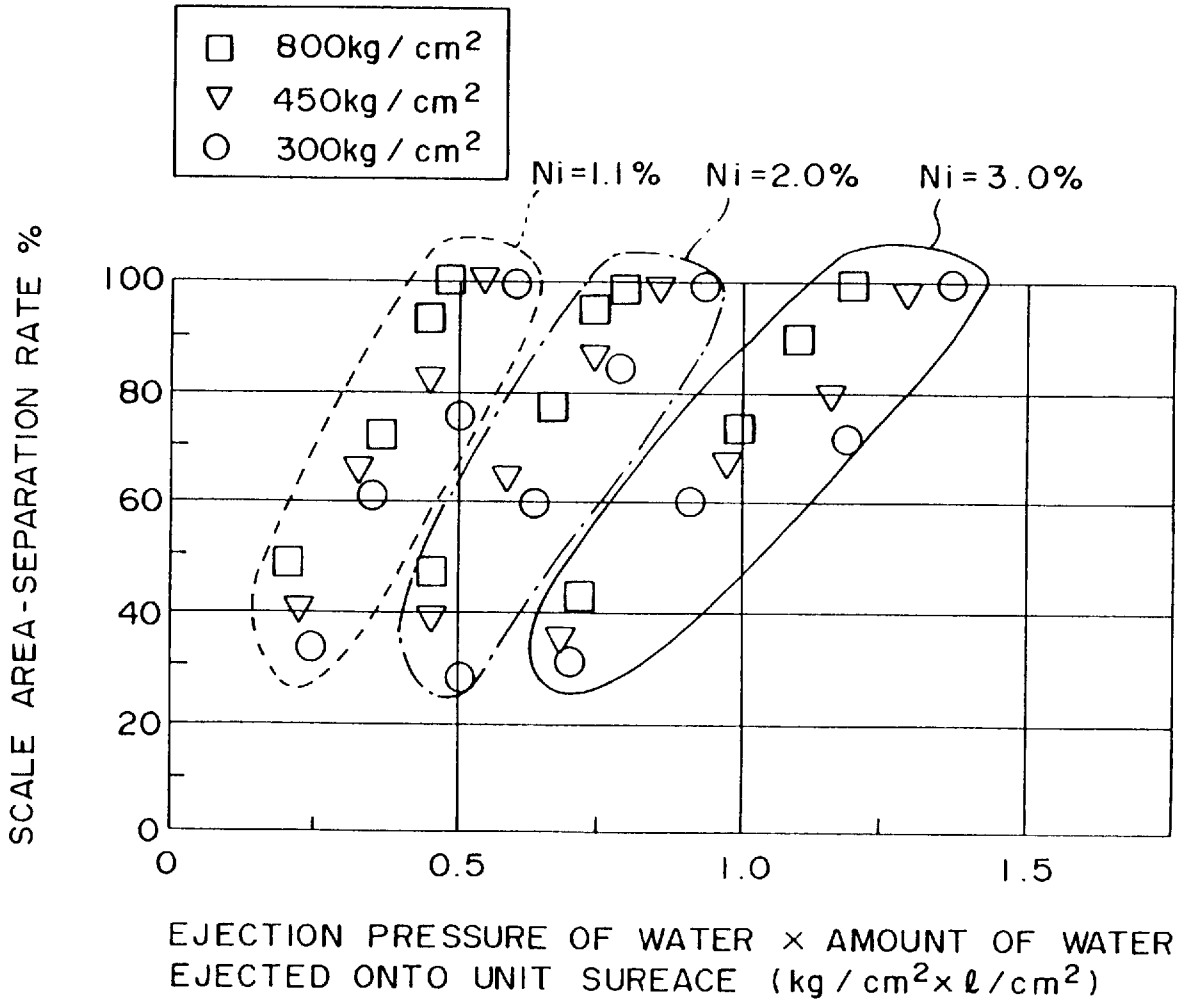
FIG. 20 is a graph showing a result of experiments in which scale is removed from each of three species of sheet steels containing 1.1 wt %, 2.0 wt % and 3.0 wt % of Ni, respectively.
Figure 21:
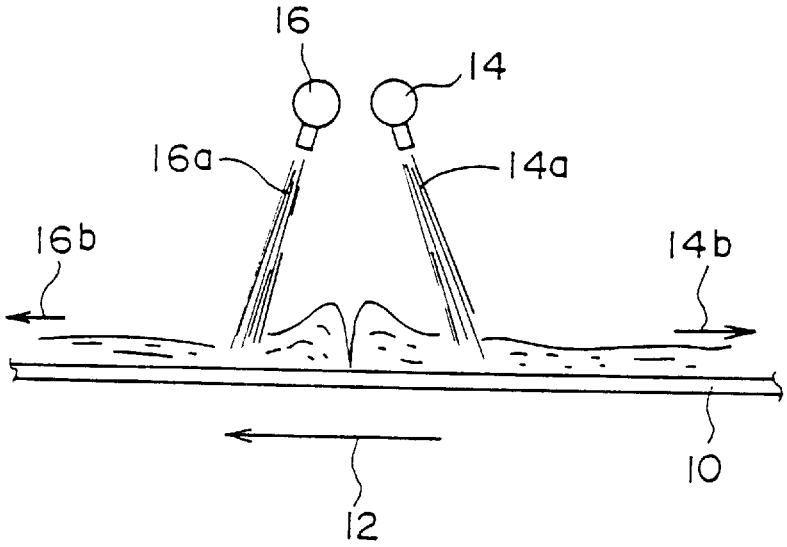
FIG. 21 is a typical illustration showing a nozzle ejecting water according to the conventional scheme, through the observation from the side of a sheet steel.
Figure 22:
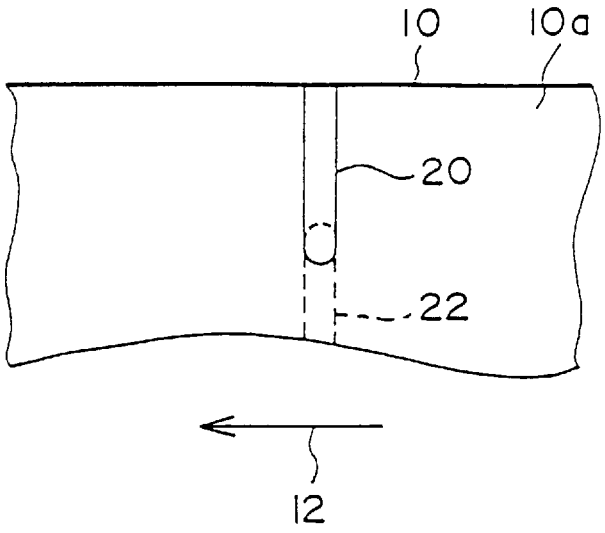
FIG. 22 is a typical illustration showing a state that waters ejected from the adjacent nozzles interfere with each other.
Figure 23:
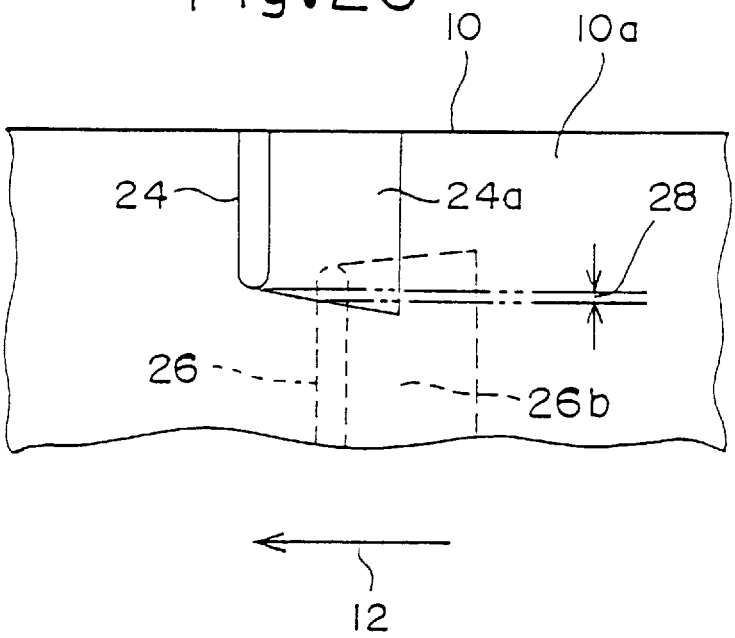
FIG. 23 is a typical illustration showing another state that waters ejected from the adjacent nozzles interfere with each other.

Also with respect to the steels containing Ni, the experiment was performed in a similar fashion as to the matter of the steels containing Si. With respect to Ni, red scale occurs at higher value in content than Si. According to FIG. 20, descaling condition, which is necessary for Ni to remove scale in a similar fashion as to the matter of Si, is given by an ejection pressure of water×an amount of water to be ejected to a surface of a sheet steel≧0.4×[% Ni][kg/cm$^2$×liter/cm$^2$×% Ni]

In general, as to descaling, there is two ways of descaling (RSB: removal of primary scale produced within a heating furnace) at the outlet of a heating furnace (before a roughing mill) and descaling (FSB: removal of secondary scale) before a finishing mill. It is indispensable for steels containing Si to practice a high pressure of descaling in FSB. On the other hand, with respect to usual steels and other steel species, it is very effective in the point of doing away with scale defects to surely remove the primary scale in RSB. The present technique (ultra high pressure descaling) is effective in both RSB and FSB.

According to the embodiments as mentioned above, while the sample is of a board-like configuration, the present invention is applicable to a bar steel such as a steel bar and H-beams.

Industrial Applicability

As mentioned above, the present invention can be used to remove a difficult-separative scale created on, for example, a hot-rolled sheet steel.

We claim:

1. A cleaning apparatus for a surface of hot rolling sheet steel in which a liquid is ejected toward the surface of the hot rolling sheet steel being transported in a predetermined carrying digestion to clean the surface of the hot rolling sheet steel, wherein said cleaning apparatus comprises:

a supplying tube, through which the liquid is supplied, extending in a direction intersecting said carrying direction; and a plurality of nozzles for ejecting the liquid supplied to said supplying tube toward the surface of the hot rolling sheet steel being transported in said predetermined carrying direction, said plurality of nozzles being coupled to said supplying tube in such a state that they are oriented to face alternately an upward-stream end with respect to said carrying direction and a downward-stream end with respect to said carrying direction along a longitudinal direction of said supplying tube; and wherein said plurality of nozzles are arranged in a direction intersecting a carrying direction of the hot rolling sheet steel.

2. A cleaning apparatus for a surface of a sheet steel according to claim 1, wherein said plurality of nozzles are disposed in such a manner that an intersecting point of jet direction axes and of the nozzles and a plane perpendicularly intersecting a path line from the central axis that extends in the longitudinal direction of said supplying tube is located on the side of the sheet steel over the central axis.

3. A cleaning apparatus for a surface of a sheet steel according to claim 1, wherein guard plates are installed between the associated adjacent nozzles connected with said supplying tube in a state that they face the upward-stream end with respect to the carrying direction along the longitudinal direction of said supplying tube, and at the position which is nearer to the end of the sheet steel than the tips of the nozzles.

4. A cleaning method for a surface of hot rolling sheet steel in which liquids are ejected from a plurality of nozzles arranged in a direction intersecting a carrying direction of the hot rolling sheet steel toward the surface of the hot rolling sheet steel to clean the surface of the hot rolling sheet steel, wherein said liquids are ejected from respective adjacent nozzles of said plurality of nozzles in mutually opposite directions as to an upward-stream end with respect to said carrying direction and a downward-stream end with respect to said carrying direction, so that said liquids collide with the surface of the hot rolling sheet steel thereby cleaning the surface of the hot rolling sheet steel.

5. A cleaning method for a surface of a sheet steel according to claim 4, wherein said the liquids are ejected from said nozzles with an ejection angle within a range between 5° and 45° with respect to normal of the surface of the sheet steel.

6. A cleaning method for a surface of a sheet steel according to claim 4, wherein a temperature of the sheet of steel is given by over 850° C. and droplets produced in a droplet flow area of a flow of said liquids ejected from said nozzles collide with the surface of the sheet steel thereby cleaning the surface of the sheet steel.

7. A cleaning method for a surface of a sheet steel according to claim 4, wherein when there is given a sheet steel containing over 0.5 wt % of Si, a temperature of the sheet of steel is given by over 850° C. and droplets produced in a droplet flow area of a flow of said liquids ejected from said nozzles collide with the surface of the sheet steel in the following condition thereby cleaning the surface of the sheet steel.

$$P(\mathrm{kg/cm^2})\times W(\mathrm{liter/cm^2})\geqq 0.8\times(\mathrm{wt\ \%\ Si})$$

where

P denotes an ejection pressure

W denotes an amount of liquid to be ejected.

8. A cleaning method for a surface of a sheet steel according to claim 6, wherein a distance L (mm) between said nozzles and the surface of the sheet steel is set up within a range satisfying the following equation.

$$y_L \leqq L \leqq y_H$$

$y_H$=390000/(x+360)+P/5−960

$y_L$=390000/(x+360)+P/29−960

P: an ejection pressure of liquid (kg/cm$^2$)

x: a spread angle (°) of nozzles $$10° \leqq x \leqq 50°.$$

9. A cleaning method for a surface of a sheet steel according to claim 6, wherein after liquids are rectified, said liquids are ejected from said nozzles.

10. A cleaning method for a surface of a sheet steel according to claim 6, wherein a distance L (mm) between said nozzles and the surface of the sheet steel is varied in accordance with the following equation, in compliance with a variation of said ejection pressure of said liquid, L=y y=390000/(x+360)+P/10−960

P: an ejection pressure of liquid (kg/cm$^2$)

x: a spread angle (°) of nozzles.

11. A cleaning method for a surface of a sheet steel in which a liquid ejected from a nozzle collides with the surface of the sheet steel containing over 0.5 wt % of Si to clean the surface of the sheet steel, wherein a temperature of the sheet of steel is given by over 850° C. and droplets produced in a droplet flow area of a flow of said liquids ejected from said nozzles collide with the surface of the sheet steel in the following condition thereby cleaning the surface of the sheet steel $$P(\mathrm{kg/cm^2})\times W(\mathrm{liter/cm^2})\geqq 0.8\times(\mathrm{wt\ \%\ Si})$$

where

P denotes an ejection pressure

W denotes an amount of liquid to be ejected.

12. A cleaning method for a surface of a sheet steel according to claim 11, wherein a distance L (mm) between said nozzles and the surface of the sheet steel is set up within a range satisfying the following equation, $$y_L \leqq L \leqq y_H$$

$$y_H = 390000/(x+360)+P/5-960$$

$$y_L = 390000/(x+360)+P/29-960$$

P: an ejection pressure of liquid ($kg/cm^2$)

x: a spread angle (°) of nozzles $$10° \leqq x \leqq 50°.$$

13. A cleaning method for a surface of a sheet steel according to claim 11, wherein after liquid is rectified, said liquid is ejected from said nozzle.

14. A cleaning method for a surface of a sheet steel according to claim 11, wherein a distance L (mm) between said nozzles and the surface of the sheet steel is varied in accordance with the following equation, in compliance with a variation of said ejection pressure of said liquid, $$L=y$$

$$y=390000/(x+360)+P/10-960$$

P: an ejection pressure of liquid ($kg/cm^2$)

x: a spread angle (°) of nozzle.

* * * * *